US007192388B2

(12) United States Patent
Dalebout et al.

(10) Patent No.: US 7,192,388 B2
(45) Date of Patent: Mar. 20, 2007

(54) FOLD-OUT TREADMILL

(75) Inventors: William T. Dalebout, North Logan, UT (US); Rodney Hammer, Lewiston, UT (US); Rick Hendrickson, Logan, UT (US)

(73) Assignee: Icon Health & Fitness, Inc., Logan, UT (US)

( * ) Notice: Subject to any disclaimer, the term of this patent is extended or adjusted under 35 U.S.C. 154(b) by 377 days.

(21) Appl. No.: 10/083,453

(22) Filed: Feb. 26, 2002

(65) Prior Publication Data

US 2002/0151413 A1 Oct. 17, 2002

Related U.S. Application Data

(60) Continuation-in-part of application No. 09/470,605, filed on Dec. 22, 1999, now Pat. No. 6,350,218, which is a continuation-in-part of application No. 09/231,208, filed on Jan. 14, 1999, now Pat. No. 6,033,347, which is a division of application No. 08/959,237, filed on Oct. 28, 1997, now Pat. No. 5,899,834.

(51) Int. Cl.
*A63B 22/00* (2006.01)
*A63B 21/00* (2006.01)

(52) U.S. Cl. ..... 482/54; 482/51

(58) Field of Classification Search ..... 482/51, 482/54; 119/700

See application file for complete search history.

(56) References Cited

U.S. PATENT DOCUMENTS

| | | | |
|---|---|---|---|
| 284,294 | A | 9/1883 | Graves |
| 321,388 | A | 6/1885 | Ruebsam |
| 663,486 | A | 12/1900 | Boren |
| 674,391 | A | 5/1901 | Baker |
| 881,521 | A | 3/1908 | Wilson |
| 897,722 | A | 5/1908 | Day |
| 931,394 | A | 8/1909 | Day |
| 937,795 | A | 10/1909 | Hackney |
| 1,016,729 | A | 2/1912 | Barrett |

(Continued)

FOREIGN PATENT DOCUMENTS

| | | |
|---|---|---|
| CA | 644774 | 7/1962 |

(Continued)

OTHER PUBLICATIONS

Brochure Entitled "*Technology for Total Fitness Genesis 2000*." 6 pages—copyright 1985.

(Continued)

*Primary Examiner*—Glenn E. Richman

(57) ABSTRACT

A fold-out treadmill includes a deck having a rear portion mounted on a base so as to be selectively rotatable between an operational position in which the deck is positioned for operation by a user positioned thereon and a storage position in which the deck is positioned proximate to the handrail. The fold-out treadmill includes a fold-out assembly configured to allow the handrail to rotate into a storage configuration when the deck is rotated from the operational position into the storage position which comprises a leg and an elongated support. The fold-out treadmill includes a mechanism that is configured to vary the inclination of the deck relative to a support surface while the deck is in the operational position and to automatically move the deck between the operational position to the storage position.

19 Claims, 11 Drawing Sheets

U.S. PATENT DOCUMENTS

| | | | |
|---|---|---|---|
| 1,020,777 | A | 3/1912 | Peterson |
| 1,064,968 | A | 6/1913 | Hagen |
| 1,082,940 | A | 12/1913 | Flora |
| 1,211,765 | A | 1/1917 | Schmidt |
| 1,715,870 | A | 6/1929 | Spain |
| 1,766,089 | A | 6/1930 | Wood |
| 1,778,635 | A | 10/1930 | Heisler |
| 1,824,406 | A | 9/1931 | Petersime |
| 1,850,530 | A | 3/1932 | Brown |
| 1,902,694 | A | 3/1933 | Edwards |
| 1,928,089 | A | 9/1933 | Blickman |
| 1,973,945 | A | 9/1934 | Chavin et al. |
| 2,067,136 | A | 1/1937 | Bridenbaugh |
| 2,165,700 | A | 7/1939 | Glynn |
| 2,177,957 | A | 10/1939 | Stewart |
| 2,219,219 | A | 10/1940 | Boger |
| 2,255,864 | A | 9/1941 | Stephens |
| 2,399,915 | A | 5/1946 | Drake |
| 2,632,645 | A | 3/1953 | Barkschat |
| 2,842,365 | A | 7/1958 | Kelley |
| 2,855,200 | A | 10/1958 | Blickman |
| 2,874,971 | A | 2/1959 | Devery |
| 3,035,671 | A | 5/1962 | Sicherman |
| 3,127,171 | A | 3/1964 | Noland et al. |
| 3,193,287 | A | 7/1965 | Robinson |
| D207,541 | S | 5/1967 | Hesen |
| 3,378,259 | A | 4/1968 | Kupchinski |
| D211,801 | S | 7/1968 | Quinton |
| 3,444,830 | A | 5/1969 | Dopetsch |
| D217,173 | S | 4/1970 | Frasier |
| D218,107 | S | 7/1970 | Feather et al. |
| 3,518,985 | A | 7/1970 | Quinton |
| D219,744 | S | 1/1971 | Hesen |
| 3,586,322 | A | 6/1971 | Kverneland |
| 3,589,715 | A | 6/1971 | Mark et al. |
| 3,592,466 | A | 7/1971 | Parsons |
| 3,602,502 | A | 8/1971 | Hampl |
| 3,606,320 | A | 9/1971 | Erwin, Jr. |
| 3,608,898 | A | 9/1971 | Berlin |
| 3,614,097 | A | 10/1971 | Blickman |
| 3,642,279 | A | 2/1972 | Cutter |
| 3,643,943 | A | 2/1972 | Erwin, Jr. et al. |
| 3,650,529 | A | 3/1972 | Salm et al. |
| 3,659,845 | A | 5/1972 | Quinton |
| 3,686,776 | A | 8/1972 | Dahl |
| 3,689,066 | A | 9/1972 | Hegan |
| 3,703,284 | A | 11/1972 | Hegan |
| 3,731,917 | A | 5/1973 | Townsend |
| 3,741,538 | A | 6/1973 | Lewis et al. |
| 3,826,491 | A | 7/1974 | Elder |
| 3,858,938 | A | 1/1975 | Kristensson et al. |
| 3,874,657 | A | 4/1975 | Niebojewski |
| 3,892,404 | A | 7/1975 | Martuccie |
| 3,904,196 | A | 9/1975 | Berlin |
| 3,909,857 | A | 10/1975 | Herrera |
| 3,918,710 | A | 11/1975 | Niebojewski |
| 3,963,101 | A | 6/1976 | Stadelmann |
| 3,966,182 | A | 6/1976 | Stadelmann et al. |
| 4,026,545 | A | 5/1977 | Schonenberger |
| 4,066,257 | A | 1/1978 | Moller |
| 4,093,196 | A | 6/1978 | Bauer |
| 4,113,071 | A | 9/1978 | Muller et al. |
| 4,151,988 | A | 5/1979 | Nabinger |
| 4,248,476 | A | 2/1981 | Phelps |
| 4,274,625 | A | 6/1981 | Gaetano |
| 4,300,761 | A | 11/1981 | Howard |
| 4,344,616 | A | 8/1982 | Ogden |
| 4,350,336 | A | 9/1982 | Hanford |
| 4,363,486 | A | 12/1982 | Chaudhry et al. |
| 4,370,766 | A | 2/1983 | Teague, Jr. |
| 4,374,587 | A | 2/1983 | Ogden |
| 4,383,714 | A | 5/1983 | Ishida |
| D270,555 | S | 9/1983 | Ogden |
| 4,406,451 | A | 9/1983 | Gaetano |
| 4,422,635 | A | 12/1983 | Herod et al. |
| 4,445,683 | A | 5/1984 | Ogden |
| 4,452,448 | A | 6/1984 | Ausherman |
| D277,304 | S | 1/1985 | Smith et al. |
| 4,502,679 | A | 3/1985 | De Lorenzo |
| D280,002 | S | 8/1985 | Smith |
| 4,544,152 | A | 10/1985 | Taitel |
| 4,544,153 | A | 10/1985 | Babcock |
| 4,566,689 | A | 1/1986 | Ogden |
| 4,572,500 | A | 2/1986 | Weiss |
| 4,576,352 | A | 3/1986 | Ogden |
| D283,239 | S | 4/1986 | Smith et al. |
| 4,580,983 | A | 4/1986 | Cassini et al. |
| 4,591,147 | A | 5/1986 | Smith et al. |
| D284,597 | S | 7/1986 | Smith et al. |
| 4,602,779 | A | 7/1986 | Ogden |
| 4,625,962 | A | 12/1986 | Street |
| 4,635,927 | A | 1/1987 | Shu |
| 4,635,928 | A | 1/1987 | Ogden et al. |
| 4,643,418 | A | 2/1987 | Bart |
| 4,645,917 | A | 2/1987 | Penney et al. |
| 4,659,074 | A | 4/1987 | Taitel et al. |
| 4,659,077 | A | 4/1987 | Stropkay |
| D289,668 | S | 5/1987 | Gremonprez et al. |
| 4,664,371 | A | 5/1987 | Viander |
| 4,664,646 | A | 5/1987 | Rorabaugh |
| 4,679,787 | A | 7/1987 | Guilbault |
| 4,687,195 | A | 8/1987 | Potts |
| D291,821 | S | 9/1987 | Kiiski |
| 4,708,337 | A | 11/1987 | Shyu |
| 4,709,918 | A | 12/1987 | Grinblat |
| 4,729,558 | A | 3/1988 | Kuo |
| 4,751,755 | A | 6/1988 | Carey, Jr. et al. |
| 4,757,987 | A | 7/1988 | Allemand |
| 4,759,540 | A | 7/1988 | Yu et al. |
| 4,776,582 | A | 10/1988 | Ramhorst |
| 4,779,845 | A | 10/1988 | Bartesch et al. |
| 4,792,134 | A | 12/1988 | Chen |
| D299,669 | S | 1/1989 | Harter |
| D300,046 | S | 2/1989 | Armstrong et al. |
| 4,805,901 | A | 2/1989 | Kulick |
| 4,813,743 | A | 3/1989 | Mizelle |
| 4,822,029 | A | 4/1989 | Samo et al. |
| 4,826,152 | A | 5/1989 | Lo |
| 4,826,153 | A | 5/1989 | Schalip |
| 4,844,449 | A | 7/1989 | Truslaske |
| 4,848,737 | A | 7/1989 | Ehrenfield |
| D304,849 | S | 11/1989 | Watterson |
| 4,886,266 | A | 12/1989 | Truslaske |
| D306,468 | S | 3/1990 | Watterson |
| D306,891 | S | 3/1990 | Watterson |
| 4,905,330 | A | 3/1990 | Jacobs |
| 4,913,396 | A | 4/1990 | Dalebout et al. |
| 4,913,423 | A | 4/1990 | Farran et al. |
| 4,921,247 | A | 5/1990 | Sterling |
| 4,927,136 | A | 5/1990 | Leask |
| 4,938,473 | A | 7/1990 | Lee et al. |
| 4,974,831 | A | 12/1990 | Dunham |
| D313,826 | S | 1/1991 | Birrell |
| 4,984,810 | A | 1/1991 | Stearns et al. |
| D315,765 | S | 3/1991 | Measom et al. |
| 4,998,725 | A | 3/1991 | Watterson et al. |
| 5,002,271 | A | 3/1991 | Gonzales |
| D316,124 | S | 4/1991 | Dalebout et al. |
| 5,007,630 | A | 4/1991 | Real et al. |
| D318,086 | S | 7/1991 | Bingham et al. |
| 5,029,801 | A | 7/1991 | Dalebout et al. |
| 5,058,881 | A | 10/1991 | Measom |
| 5,062,626 | A | 11/1991 | Dalebout et al. |
| 5,062,632 | A | 11/1991 | Dalebout et al. |

5,072,928 A 12/1991 Stearns et al.
D323,009 S 1/1992 Dalebout et al.
D323,198 S 1/1992 Dalebout et al.
D323,199 S 1/1992 Dalebout et al.
5,085,426 A 2/1992 Wanzer et al.
5,088,729 A 2/1992 Dalebout
5,102,380 A 4/1992 Jacobson et al.
5,109,778 A 5/1992 Berkowitz
5,110,117 A 5/1992 Fisher et al.
5,145,475 A 9/1992 Cares
5,163,885 A 11/1992 Wanzer et al.
5,178,599 A 1/1993 Scott
D333,330 S 2/1993 Clem
5,184,988 A 2/1993 Dunham
5,192,255 A 3/1993 Dalebout et al.
5,195,935 A 3/1993 Fencel
5,207,622 A 5/1993 Wilkinson et al.
5,207,628 A 5/1993 Graham
5,254,067 A 10/1993 Habing et al.
D342,107 S 12/1993 Chang
5,279,528 A 1/1994 Dalebout et al.
D344,557 S 2/1994 Ashby
5,282,776 A 2/1994 Dalebout
5,284,461 A 2/1994 Wilkinson et al.
5,295,928 A 3/1994 Rennex
5,299,992 A 4/1994 Wilkinson
5,308,301 A 5/1994 Chiarello
D348,493 S 7/1994 Ashby
D348,494 S 7/1994 Ashby
5,328,420 A 7/1994 Allen
5,328,422 A 7/1994 Nichols
5,336,146 A 8/1994 Piaget et al.
5,338,277 A 8/1994 Yang
5,344,372 A 9/1994 Hung
D351,202 S 10/1994 Bingham
D351,633 S 10/1994 Bingham
5,352,166 A 10/1994 Chang
5,352,167 A 10/1994 Ulicny
5,352,169 A 10/1994 Eschenbach
5,353,452 A 10/1994 Rulis
5,356,357 A 10/1994 Wang et al.
5,370,594 A 12/1994 Grinblat
5,372,559 A 12/1994 Dalebout et al.
5,378,212 A 1/1995 Pin-Kuo
5,382,209 A 1/1995 Pasier et al.
5,385,519 A 1/1995 Hsu et al.
5,403,254 A 4/1995 Lundin et al.
5,407,408 A 4/1995 Wilkinson
5,429,563 A 7/1995 Engel et al.
D361,806 S 8/1995 Bartlett
D361,807 S 8/1995 Bartlett
5,439,432 A 8/1995 Lundin et al.
5,439,433 A 8/1995 Lundin et al.
5,441,467 A 8/1995 Stevens
5,447,479 A 9/1995 Gvoich
5,454,770 A 10/1995 Stevens
5,460,586 A 10/1995 Wilkinson et al.
5,476,431 A 12/1995 Wilkinson et al.
5,484,362 A 1/1996 Skowronski et al.
5,496,235 A 3/1996 Stevens
5,512,025 A 4/1996 Dalebout et al.
5,518,471 A 5/1996 Hettinger et al.
5,527,245 A 6/1996 Dalebout et al.
5,529,553 A 6/1996 Finlayson
5,533,948 A 7/1996 Wilkinson
D375,063 S 10/1996 Stevens
D376,777 S 12/1996 Stevens
5,591,106 A 1/1997 Dalebout et al.
5,595,556 A 1/1997 Dalebout et al.
5,599,259 A 2/1997 Skowronski et al.
5,603,675 A 2/1997 Wu
5,607,375 A 3/1997 Dalebout et al.
5,626,539 A 5/1997 Piaget et al.
5,662,557 A 9/1997 Watterson et al.
5,667,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,332 A 11/1997 Watterson et al.
D387,402 S 12/1997 Coody et al.
5,702,325 A 12/1997 Watterson et al.
5,704,879 A 1/1998 Watterson et al.
5,707,319 A 1/1998 Riley
5,708,060 A 1/1998 Sands et al.
5,709,632 A 1/1998 Socwell
5,711,745 A 1/1998 Yang
5,718,657 A 2/1998 Dalebout et al.
5,722,922 A 3/1998 Watterson et al.
5,733,228 A 3/1998 Stevens
5,743,833 A 4/1998 Watterson et al.
5,746,682 A 5/1998 Hung
5,772,560 A 6/1998 Watterson et al.
5,810,696 A 9/1998 Webb
5,827,155 A 10/1998 Jensen et al.
5,830,113 A 11/1998 Coody et al.
5,833,577 A 11/1998 Hurt
5,855,537 A * 1/1999 Coody et al. ..... 482/54
5,860,893 A 1/1999 Watterson et al.
5,860,894 A 1/1999 Dalebout et al.
5,868,648 A 2/1999 Coody et al.
5,899,834 A 5/1999 Dalebout et al.
6,013,011 A 1/2000 Moore et al.
6,033,347 A 3/2000 Dalebout et al.
6,045,490 A 4/2000 Shafer et al.
6,050,921 A 4/2000 Wang
6,050,923 A 4/2000 Yu
6,059,695 A * 5/2000 Hung ..... 482/54
6,068,578 A 5/2000 Wang
6,110,076 A 8/2000 Hurt
6,132,340 A 10/2000 Wang et al.
6,174,268 B1 1/2001 Novak
6,179,753 B1 1/2001 Barker et al.
6,231,482 B1 5/2001 Thompson
6,234,936 B1 5/2001 Wang
6,273,843 B1 8/2001 Lo
6,280,362 B1 8/2001 Dalebout et al.
6,312,363 B1 11/2001 Watterson et al.
6,325,725 B1 12/2001 Yu
6,350,218 B1 2/2002 Dalebout et al.
6,471,622 B1 10/2002 Hammer et al.
6,579,211 B2 6/2003 Wu
6,638,200 B2 10/2003 Chang
6,974,404 B1 12/2005 Watterson
2005/0148443 A1 7/2005 Watterson et al.

FOREIGN PATENT DOCUMENTS

CN 222239 4/1994
CN 223261 5/1994
CN 238211 1/1995
DE 83466 8/1908
DE 1044 355 10/1954
DE 1057 928 8/1957
DE 2 225 342 12/1973
DE 2408 052 C3 12/1973
DE 3601 181 A1 1/1986
EP 0 095 226 3/1983
FR 740 943 8/1932
FR 1432392 5/1965
FR 2 527 457 5/1982
FR 2 677 257 6/1991
GB 15447 11/1908
GB 382340 10/1932
GB 384019 12/1933
GB 1169148 10/1969

| | | | |
|---|---|---|---|
| GB | 1 326 263 | | 8/1973 |
| GB | 1495436 | | 12/1977 |
| GB | 1 505 702 | | 3/1978 |
| GB | 2 120 560 | | 12/1983 |
| GB | 2 152 825 | A | 8/1985 |
| GB | 2 212 279 | A | 8/1989 |
| GB | 2 274 599 | A | 8/1994 |
| GB | 2 274 600 | A | 8/1994 |
| JP | 81/01960 | | 4/1981 |
| JP | 56-56358 | | 5/1981 |
| JP | 56-150562 | | 11/1981 |
| RU | 1297879 | A1 | 2/1985 |
| SU | 825122 | | 7/1977 |
| SU | 1248615 | | 8/1986 |

OTHER PUBLICATIONS

Brochure Entitled "*Technology for Total Fitness Genesis 3000.*" 7 pages—copyright 1985.
Cover and selected pages from the Taiwan Buyer's Guide—1993.
Cover Page, p. 2 and 81 from Brochure Entitled "*Taiwan Sports Goods*" (Buyer's Guide '95).
The Battle Creek Health Walker Catalog—1958.
Owner's Manual for Cross Walk Advantage—1994.
Brochure Entitled "*Technology for Total Fitness Genesis 4000*", available on information and belief, as early as May 1996 (5 pages).
Brochure Entitled "*Keep Fit with Pioneer Exerciser*", available on information and belief, as early as May 1996 (4 pages).
Treadmill Owner's Manual by Formula 22100 Manual Treadmill, undated (available on information and belief, as early as Sep. 1998; *see also* "Other Material Information" in the Information Disclosure Statement).
Damark International, Inc. Mail Order Catalog, dated Nov. 17, 1994, cover page and p. 6.
Sears, Roebuck and Co., *Pro-Form 585 TL Low Profile Treadmill, User's Manual*, Copyright 1996.
AerobicRider Brochure, 4 pages without page numbers.
Advertisement for Sportmart Health & Fitness for the "The Step" (Sportmart Health & Fitness, Jan. 23, 1993, 1 page).
Advertisement for "The Step" and "The Step II" (Sears the Great American Wish Book 1991, 2 pages, pp. title page, 600-601).
Advertisement for "Introducing The New Step Reebok Platform" Designed to Meet the Demands of the Health Club Industry (© 1993 Reebok International Ltd., 1 page).
Advertisement for "The Step II" (Winter 1995 Home Fitness buyers Guide, 2 pages, pp. 69-70).
Brochure for Cintas De Footing Spirit, Apr. 2, 1993, 1 page.
Brochure for Contour Jogger by BattleCreek Equipment, © 1979 Battle Creek Equipment Company, 2 pages.
Brochure for Fitness Equipment & Accessories, 51 pages, pp. 53-57, 64, 67, 70, 72, 76-84, 105, 4-5, 12, 16-32, 37-41, 50, 52(some pages are enclosed without page numbers).
Brochure for Fitness Sonner Land, 6 pages without page numbers.
Brochure for Flex 'n' Stride, printed Jul. 6, 1993, 5 pages.
Brochure for Genesis 1000", Technology for Total Fitness entitled "The Optimum Performance Home Fitness Center" (© Genesis, Inc., Sep. 1985, 1 page).
Brochure for Genesis 2000", Technology for Total Fitness entitled "The Ultimate in Home Exercise Equipment" (© Genesis, Inc., Sep. 1985, 2 pages).
Brochure for Genesis 3000", Technology for Total Fitness entitled "The Dynamic Answer to Home Fitness and Health" (© Genesis, Inc., Sep. 1985, 1 page without page number).
Brochure for Genesis4000", Technology for Total Fitness entitled "The Modern Approach to Home Fitness and Health" (© Genesis, Inc., Sep. 1985, 2 pages without page numbers).
Brochure for Genesis 5000", Technology for Total Fitness entitled "The Advancement In Home Fitness and Convenience" (© Genesis, Inc., 1985, 1 page).
Brochure for Genesis 6000", Technology for Total Fitness entitled "Maximum Workout in Minimal Space" (© Genesis, Inc., 1985, 1 page).
Brochure for JKExer Built For Health, 16 pages without page numbers.
Brochure for JKExer Built For Health, 28 pages without page numbers.
Brochure page "Treadmills and Benches," for Apache MT-006.
Brochure for MacLevy, 5 pages without numbers.
Brochure for Otros Productos Sonnen Land, printed Apr.2, 1993, 1 page.
Brochure for Quinton Instruments, 1974, 34 pages, pp. title page, 1-32 (some pages are enclosed without pages numbers.)
Brochure for Roadmaster Fitness Equipment 1989 (© Roadmaster Corporation 1989, 6 pages).
Brochure for Sears.Sport, 6 pages, pp. 498-503.
Brochure for Service Merchandise, 3 pages without page numbers.
Brochure for SpaceMaker 1000 LS, 1 page without page number.
Brochure for Spirit, 8 pages without page numbers.
Brochure for Taiwan, 2 pages without page numbers.
Brochure entitled "Technology for Total Fitness Genesis 1000", (© 1985 Genesis, Inc.) 6 pages.
Brochure for Vitamaster® 1988 Product Line entitled "*Vitamaster®*" (Vitamaster Industries, Inc., 1988, 10 pages without page numbers.
Diagram of "HealthRider®" Parts Description (Apr. 26, 1994, 1 page without page number).
Formula Ventures Owners Manual 22115 Manual Treadmill, upon information and belief, available in 1994, 20 pages.
HealthWare 87580M Treadmill Owner's Manual, 3 pages without page numbers.
JCPenney Catalog, 1 page, pp. 740.
Nordic Track Fitness At Home Catalog, available on information and belief at aleast as early as Dec. 1994, 36 pages.
Photographs of foldable treadmills, Formula Ventures, available on information and belief at least as early as 1994.
Sears 1993 Spring/Summer Annual Catalog, 26 pages, pp. title page, 1384-1405, 1411 (some pages are enclosed without page numbers.
Spirit SL445 P Motorized Treadmill Owners Manual, 23 pages, pp. title page, 1-21.
Spirit SR275PH\SL445 PH Motorized Treadmill Owners Manual, 28 pages, pp. title page, 1-26.
Spirit SR275 P Motorized Treadmill Owners Manual, 22 pages, pp. title page, 1-20.
Spirit New Model SR275 P Motorized Treadmill Owners Manual, 23 pages, pp. title page, 1-21.
StepShaper Step by Step Workout Video Covers, 3 pages without page numbers.
Taiwan Sporting Goods Buyers Guide, Mid-Year Supplement 1989, by Tradewinds, 15 pages, pp. title page, 4, 6, 56-57, 59, 61, 64, 68-69, 76-77 (some pages are enclosed without page numbers).
Taiwan Buyers Guide, Sporting Goods 1989, by Tradewinds, 12 pages, pp. title page, 17, 24, 163, 190, 196-197, 214 (some pages are enclosed without page numbers).
Taiwan Sporting Goods Buyers Guide, Mid-Year Supplement 1990, by Tradewinds, 15 pages, pp. title page, 63, 65, 69-70, 78-79, (some pages are enclosed without page numbers).
Taiwan Sporting Goods Buyers Guide, Mid-Year Supplement 1991, by Tradewinds, 11 pages, pp. title page, 61, 69, 73, 76, 78, 91 (some pages are enclosed without page numbers).
Taiwan Sporting Goods Buyers Guide 1991, by Tradewinds, 41 pages, pp., 19-20, 25-31, 171, 182, 188-190, 194-195, 198-199, 204-205, 223-225, 227-231, 235 (some pages are enclosed without page numbers).
Taiwan Sporting Goods Buyers Guide, Mid-Year Supplement 1992, by Tradewinds, 22 pages, pp. title page, 9-12, 87-89, 95, 104, 107, 115-116, 120-122 (some pages are enclosed without page numbers).
Taiwan Sporting Goods Buyers Guide 1992, by Tradewinds, 58 pages, pp. title page, 18, 24, 26-28, 159, 164-174, 179, 185, 198-199, 202, 210-212, 215, 222, 226, 234, 237, 245, 250, 396-397, 399, 402, (some pages are enclosed without page numbers).
Taiwan Sporting Goods Buyers Guide, Mid-Year Supplement 1993, by Tradewinds, 24 pages, pp. title page, 2, 15-16, 101-102, 111-112, 115, 119, 137, 141, 143-144, 243 (some pages are enclosed without page numbers).

Taiwan Sporting Goods Buyers Guide 1993, by Tradewinds, 6 pages, pp. title page, 197, 215, 275 (some pages are enclosed without page numbers).
Taiwan Sporting Goods Buyers Guide, Mid-Year Supplement 1994, by Tradewinds, 22 pages, pp. title page, 94, 97, 116, 120, 126, 146, 150, 163 (some pages are enclosed without page numbers).
Taiwan Sporting Goods Buyers Guide 1994, by Tradewinds, 38 pages, pp. title page, 11, 154, 177-178, 198-199, 205-206, 208, 217, 222, 232, 242-243, 258-259, 262-263, 290, 292 (some pages are enclosed without page numbers).
Taiwan Sporting Goods Buyers Guide 1995, Tradewinds, 79 pages, pp. title page, 12-15, 18, 20-21, 25-32, 109, 158-160, 164, 181, 188, 197, 200, 202-204, 206, 221, 228, 232, 238, 264-265, 270-271, 274-275, 278-279, 282, 288, 290-292, 295-297, 304, 316-317, 321, 323, 329-331, 333, 550-551, (some pages are enclosed without page numbers).
The New Yorker, Mar. 6, 1989, 5 pages without page numbers.
Th Puch Jogger, 1977, 2 pages without page numbers.
Treadmill SR195 Owners Manual and Operating Instructions, 22 pages without page numbers.
Treadmill SR285 Owners Manual and Operating Instructions, 25 pages, pp. title page, 1-23.
"Treadmills." Comsumer Reports, available on information and belief at least as early as Dec. 1997, 5 pages.
"Treadmills." Comsumer Reports, available on informationa and belief at least as early as Oct. 1990, 8 pages.
"Treadmills for Jogs and 'Walkouts.'" Comsumer Reports, Jan. 1996, 5 pages.
Trotter Advertisement: "Introducing the 575 Club Trainer: One Piece of Equipment for Walking, Jogging, Running, and Climbing, " available on information and belief at least as early as 1992 (2 pages).
Tunturi Fitness Products II Brochure, 8 pages without page numbers.
Voit Advertisement "Body Jack" (Damark, Nov. 14, 1994, 1 page without page number).
Voit Advertisement "Gravity Rider" with enlarged photocopy (Damark, Jul. 28-Aug. 1, 1994, 2 pages without page number.
Voit Advertisement "Gravity Rider" (Damark, Jul. 28, 1994, 2 pages, pp. 34-35).

* cited by examiner

FOLD-OUT TREADMILL

CROSS-REFERENCE TO RELATED APPLICATIONS

This patent application is a continuation-in-part of U.S. Pat. application Ser. No. 09/470,605, filed on Dec. 22, 1999, now U.S. Pat. No. 6,350,218, issued on Feb. 26, 2002, in the names of William T. Dalebout, Rodney Hammer, and Rick Hendrickson, and entitled "Fold-out Treadmill," which is a continuation-in-part of application Ser. No. 09/231,208 filed Jan. 14, 1999 now U.S. Pat. No. 6,033,347, issued on Mar. 7, 2000 to William T. Dalebout, Rodney Hammer, and Rick Hendrickson, and entitled "Fold-out Treadmill," which is a divisional of application Ser. No. 08/959,237 filed Oct. 28, 1997, now U.S. Pat. No. 5,899,834, issued on May 4, 1999, to William T. Dalebout, Rodney Hammer, and Rick Hendrickson, and entitled "Fold-out Treadmill," all of which are incorporated herein by reference.

BACKGROUND OF THE INVENTION

1. The Field of the Invention

The present invention relates to treadmills, and in particular to foldable treadmills.

2. The Relevant Technology

Treadmills are popular exercise machines that enable a user to engage in a running or walking movement while maintaining a relatively stationary position. A conventional treadmill includes two major sections: a base and a handrail. The base includes a frame having rollers mounted on opposing ends thereof. A continuous belt extends around and between the two rollers so as to be fashioned into a flat, continuous loop. In one design, an electrical motor is connected to the front roller. When the motor is turned on, the roller spins which imparts rotational movement to the belt. In an alternative design, no motor is provided. The continuous belt is rotated by the user standing on the belt and walking or running thereon. Friction between the user and the belt cause the belt to rotate in a continuous loop around the rollers.

The handrail acts as a support or stabilizer for the user. Conventional handrails project from the frame toward and across the front of the treadmill. Some alternative treadmills include moveable arms attached to the handrail. The movable arms enable the user to exercise their arms while running or walking on the treadmill.

A control console can also be mounted on the handrail. The control console is used to control the operation of the treadmill and to display related information such as elapsed time, speed, pulse, or calories burned. Controls for treadmill speed, inclination, or exercise program may also be part of the control console.

To use the treadmill, a user steps onto the continuous belt facing the front of the treadmill. The electric motor is then turned on causing the top surface of the belt to rotate from the front of the base to the rear of the base. To maintain a stationary position on the treadmill, the user must then walk or run at a speed corresponding to the speed of the belt. If desired, the user can grasp the handrail for support. When the user is done exercising, he or she simply turns the treadmill off and steps off the continuous belt.

Early treadmills tended to be bulky due to large motors and oversized parts. Such treadmills were difficult to move around and took up relatively large amounts of space. Accordingly, these early treadmills were almost exclusively found in spas and gyms having large amounts of floor space.

As engineering improved, the size and weight of treadmills decreased. Nevertheless, the size of treadmills was limited by the length and width of the base which had to be large enough for a user to safely walk or run thereon. Due to this minimum size limitation, treadmills were significantly precluded from home or apartment use which did not have available space to house a treadmill.

In an attempt to remedy this problem, foldable treadmills were developed. Foldable treadmills include a base having rollers and a continuous belt as previously described. The front of the base, however, is hingedly attached to a stationary stand. Upstanding from the stationary stand is a handrail. The base can be selectively moved between an operational and storage position. In the operation position, the base is positioned for use by a user and is substantially parallel with the support surface. Many treadmills do, however, have the ability to change the position of the base relative to the support surface to simulate walking uphill. To use the treadmill, the user stands on the base facing the stationary stand and walks or runs thereon as discussed above. When use is completed, the base can be selectively moved to a storage position by lifting up the rear end of the base. The base is lifted to the storage position where it is in a substantially upright position with the front end of the base still rotatably connected to the stationary stand. By folding up the base, the treadmill takes up substantially less floor space making the treadmill more accessible for use in homes and apartments.

While foldable treadmills take up less space, they still have other drawbacks. For example, to minimize obstruction by the treadmill, it is desirable for the treadmill to be folded up against a wall, when not in use. The stationary stand must be positioned proximate to the wall to enable the base to fold out. With the treadmill positioned so that the stationary stand is closest to the wall a user is forced to face the wall during use of the treadmill. The user, however, typically prefers to look into the room, such as toward a television or other people, during use.

To enable a user to face into a room during use of a conventional foldable treadmill, the user must first rotate the stationary stand away from the wall, and then move the treadmill sufficiently far away from the wall so that the base does not hit the wall when the base is lowered into the operational position. When use is completed, the user must fold up the treadmill and move it back to the wall for storage. This required moving of the treadmill for each use is time consuming, annoying, and awkward. Further, treadmills are typically heavy and fairly large, making them physically difficult to move. Even those treadmills that are "portable" require a great deal of effort to move and reposition so that the user can face away from the wall. As a result, the frequency of use of the treadmill is decreased, thereby partially defeating the purpose of the treadmill.

Another problem with the existing folding treadmills is that the user must manually lift the deck into the storage position. While some types of folding treadmills have some type of a lift assistance assembly oil mechanism which helps a user lift the deck of the treadmill, the user must still manually lift the deck. It would be desirable to have a treadmill that was a folding treadmill but would not require the user to manually lift the deck of the treadmill from the operational position to the storage position.

BRIEF SUMMARY OF THE INVENTION

A foldable or fold-out treadmill is provided which comprises a handrail and a support structure that includes a deck and a stationary base. The deck has a front portion, a rear portion, and a continuous belt rotatably mounted thereon. The rear portion of the deck is moveably mounted on the base so as to enable the deck to be selectively rotated between an operational position in which the deck is positioned for operation by a user positioned thereon and a storage position in which the deck is positioned proximate to the handrail.

The treadmill also includes a handrail movingly attached to the support structure. The handrail has a second end and an opposing first end projecting above the front end of the deck when the deck is in the operational position. The handrail is further configured such that when the deck is moved between the operational position and the storage position the handrail rotates into a storage configuration.

The treadmill also includes a fold-out assembly that movably connects the second end of the handrail to the support structure so as to enable the first end of the handrail to project above the front portion of the deck when the deck is in the operational position and to rotate into a storage configuration when the deck is rotated into the storage position. The fold-out assembly is configured such that the handrail rotates into the storage configuration as the deck is selectively rotated from the storage position into the operational position. In one embodiment, the fold-out assembly comprises a leg and an elongated support. The leg has a proximal end attached to the handrail and a distal end rotatably connected to the base. The elongated support has one end movingly attached to the deck and the opposite end movingly coupled to the handrail. The elongated support and the leg are configured to allow the handrail to rotate into a storage configuration when the deck is rotated from the operational position into the storage position.

The fold-out treadmill also includes a mechanism configured to vary the inclination of the deck relative to a support surface while the deck is in the operational position. The mechanism comprises a motor that is movably attached to the base and a foot that is rotatably attached to the deck. The mechanism also includes an elongated member that has one end movably attached to the motor and an opposite end moveably connected to the foot.

In another embodiment, the fold-out treadmill includes a mechanism configured to automatically move the deck between the operational position to the storage position. The mechanism comprises a motor that is movably attached to the base and an elongated member that has one end movably attached to the motor and an opposite end moveably connected to the deck.

In another embodiment, the fold-out treadmill includes a mechanism that is configured to vary the inclination of the deck relative to a support surface while the deck is in the operational position and to automatically move the deck between the operational position to the storage position. The mechanism comprises a motor that is movably attached to the base and a foot that is rotatably attached to the deck. The mechanism also includes an elongated member that has one end movably attached to the motor and an opposite end moveably connected to the foot.

These and other features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not, therefore, to be considered to be limiting of its scope, the invention will be described and explained with additional specificity and detail through the use of the accompanying drawings in which.

DETAILED DESCRIPTION OF THE PREFERRED EMBODIMENTS

Figure 1:
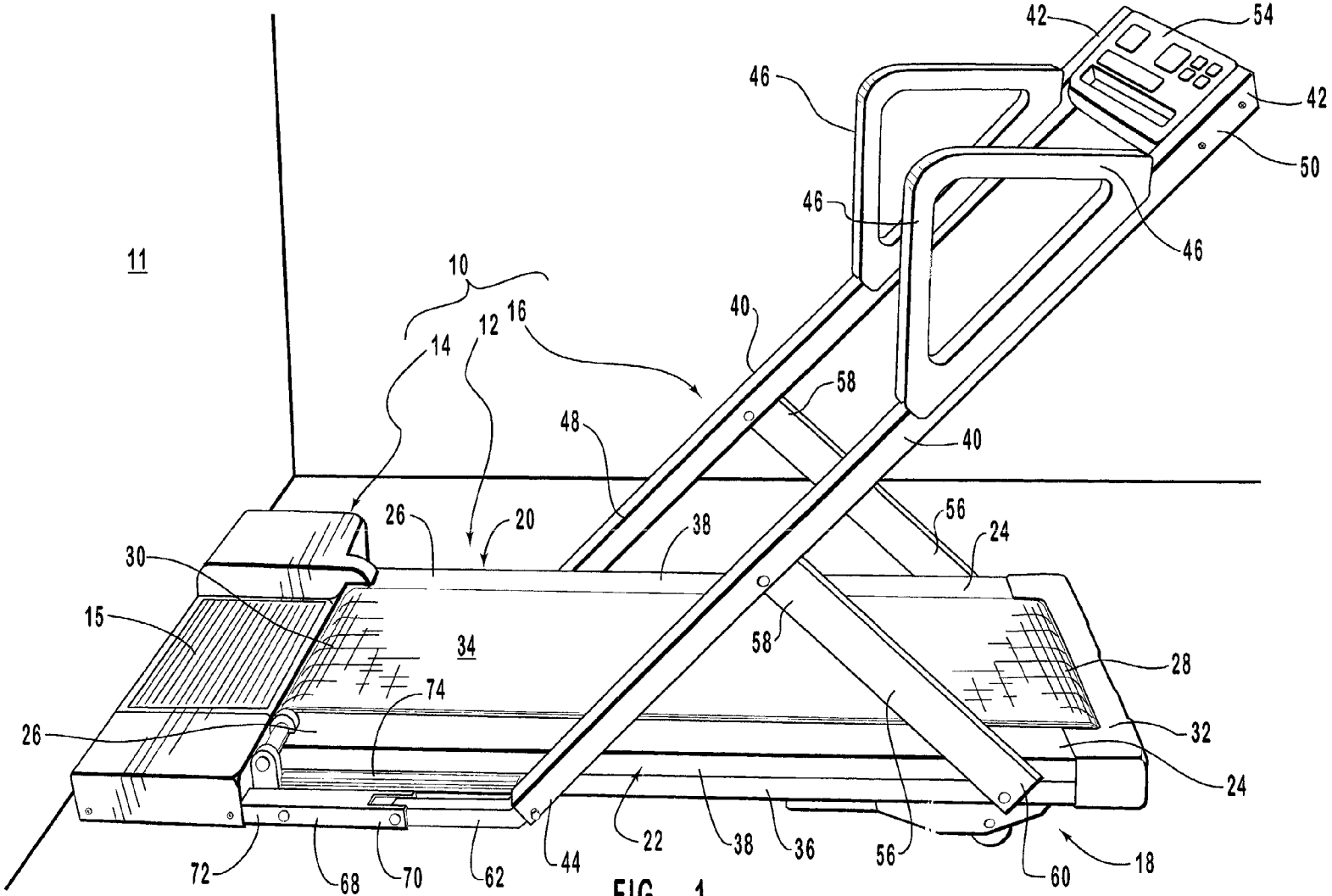
FIG. 1 is a perspective view of one embodiment of the fold-out treadmill in an operational position.

The present invention relates to treadmills that are selectively foldable and enable a user to face into a room while exercising on the treadmill that is positioned substantially against a wall. Depicted in FIG. 1 is one embodiment of a treadmill incorporating the features of the present invention. Treadmill 10 includes a deck 12 and a handrail 16. Deck 12 is moveable between an operational position, where deck 12 is substantially flat or otherwise positioned for use by a person positioned thereon, and a storage position in which deck 12 is positioned proximate to handrail 16. Handrail 16 projects above deck 12 when deck 12 is in the operational position and automatically collapses into substantial alignment with deck 12 when deck 12 is rotated into the storage position.

More specifically, fold-out treadmill 10 comprises a base 14, deck 12, and handrail 16. Deck 12 has a back end 30 and a front end 28. Back end 30 of deck 12 is hingedly mounted to base 14. Together, deck 12 and base 14 form the support structure of treadmill 10. One embodiment of treadmill 10 is illustrated in FIG. 1 with deck 12 in an operational position.

Figure 3:
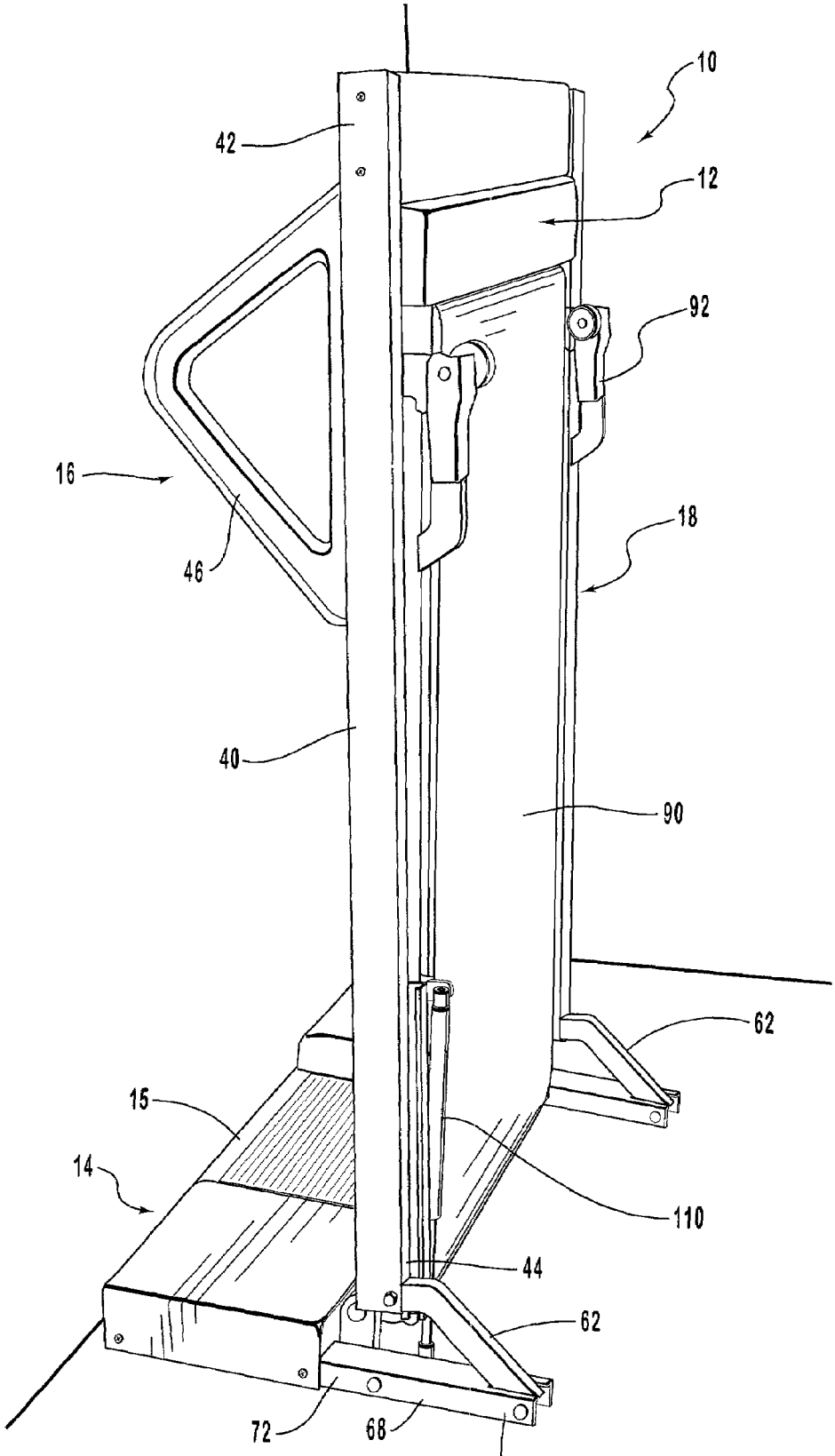
FIG. 3 is a perspective view of the fold-out treadmill shown in FIG. 1 folded into a storage position.

In the operational position, deck 12 extends outwardly from base 14 and is positioned for use by a user positioned thereon. In the operational position, deck 12 may be substantially level or somewhat inclined depending on the user's preference. Deck 12 also has a storage position in which deck 12 is positioned proximate to handrail 16, as shown in FIG. 3. In one embodiment, when deck 12 is in the storage position, it is substantially upright. Deck 12 can be selectively rotated between the operational position and the storage position.

Referring to FIG. 1, deck 12 comprises a frame structure 18 that includes a left frame member 20 and a right frame member 22. Left and right frame members 20 and 22, respectively, are defined when deck 12 is in the operational position and the user is facing front end 28 of deck 12. As shown in FIG. 1, left frame member 20 and right frame member 22 are generally aligned. Left frame member 20 and right frame member 22 each have a forward end 24 and a back end 26.

In one embodiment illustrated in FIG. 1, deck 12 also comprises an optional front member 32. Front end 28 of deck 12 is defined as the forward-most end of deck 12 when deck 12 is in the operational position. A user faces front end 28 of deck 12 when using treadmill 10. Conversely, back end 30 of deck 12 is defined as the rear-most end of deck 12 proximate to base 14. Back end 30 of deck 12 is rotatably connected to base 14.

An optional front member 32 is attached to forward end 24 of both left frame member 20 and right frame member 22 at front end 28 of deck 12. In one embodiment, left frame member 20, right frame member 22, and front member 32 form frame structure 18 of deck 12. Left frame member 20 and right frame member 22 are in a longitudinal, spaced apart relationship while front member 32 is a cross member that extends laterally between forward end 24 of left frame member 20 and forward end 24 of right frame member 22. Alternatively, frame structure 18 may comprise left frame member 20 and right frame member 22.

Deck 12 has a continuous or endless belt 34 mounted on deck 12. In particular, continuous belt 34 is positioned between left frame member 20 and right frame member 22. Continuous belt 34 is configured to receive a user thereon to perform exercises, including walking, running, jogging and other similar or related activities. Treadmill 10 can also be used for stationary exercises, such as stretching or bending, while the user is standing on continuous belt 34. The primary function, however, of treadmill 10 is for running, walking or jogging.

One embodiment of left frame member 20 and right frame member 22 of frame structure 18 comprises a side rail 36 and a side base 38. As illustrated in FIG. 1, side base 38 is positioned over the top of side rail 36 of both left frame member 20 and right frame member 22. Left frame member 20 is not totally visible in FIG. 1 but is a mirror image of right frame member 22. Side bases 38 of left frame member 20 and right frame member 22 are capable of supporting the weight of a user standing thereon. Side bases 38 are positioned on each side of continuous belt 34.

The position of side bases 38 of both left frame member 20 and right frame member 22 are such that a user of treadmill 10 can comfortably and easily step off of continuous belt 34 onto one or both of side bases 38. The user can also stand on side base 38 of either left frame member 20 or right frame member 22 or both until he or she is ready to step onto continuous belt 34. In addition, side bases 38 are wide enough for the user to comfortably place his or her foot thereon. It can be appreciated that other embodiments of left frame member 20 and right frame member 22 or the components thereof are equally effective in carrying out the intended function thereof.

Treadmill 10 also comprises base 14 that is movably attached to back end 30 of deck 12. One embodiment of base 14, shown in FIG. 1, includes main body 15 and a pair of stabilizer members 68. Stabilizer members 68 have a forward end 70 and a back end 72. Back end 72 of each stabilizer member 68 is fixedly attached to main body 15 of base 14 near the periphery thereof and extends outwardly from main body 15 in a direction generally parallel with deck 12 when deck 12 is in the operational position.

Main body 15 of base 14 is positioned substantially directly behind endless belt 34 such that should the user roll backwards off of endless belt 34, he or she will land on main body 15 of base 14. Main body 15 has a low profile as will be discussed below that enables main body 15 to be slightly shorter in height than endless belt 34 when deck 12 is in the operational position. This helps to prevent the user from hitting base 14 while running or walking on treadmill 10. Base 14 is also configured to rest on a support surface with its rear end abutting, or in close proximity to, a wall.

One embodiment of treadmill 10 includes a switching mechanism on base 14 that automatically turns off motor 98 when the user is on main body 15 and, consequently, prevents a user from being trapped on main body 15 after inadvertently landing on main body 15 while treadmill 10 continues to run.

In one embodiment, back end 30 of deck 12 is rotatably attached to base 14 by conventional methods. Specifically, back end 26 of both left frame member 20 and right frame member 22 is pivotally attached to base 14, and base 14 extends laterally across back end 26 of both left frame member 20 and right frame member 22. Various other embodiments of structure capable of performing the function of a means for connecting deck 12 to base 14 so as to enable deck 12 to selectively rotate between the operational position in which deck 12 is positioned for use by a user, and a storage position in which deck 12 is proximate to handrail 16, are equally effective in performing the intended function thereof.

FIG. 1 also shows one embodiment of handrail 16 that is movably attached to base 14 and deck 12. One embodiment of handrail 16 is substantially U-shaped. When deck 12 is in the operational position handrail 16 is open at the rear-most portion and closed at the front-most portion. As shown in FIG. 1, handrail 16 extends across deck 12 at front end 28 of deck 12 when deck 12 is in the operational position. It can be appreciated that various other configurations of handrail 16 are equally effective in performing the intended function thereof.

Handrail 16 is configured to automatically collapse into substantial alignment with deck 12 when deck 12 is in the storage position, as shown in FIG. 3. As illustrated in FIG. 1, in one embodiment, handrail 16 has a first end 48 and a second end 50. First end 48 of handrail 16 is attached to base 14, and second end 50 of handrail 16 projects above front end 28 of deck 12 when deck 12 is in the operational position.

Referring again to FIG. 1, handrail 16 comprises a pair of uprights 40. For clarity, the right side of handrail 16 is described, keeping in mind that the left side thereof, is the mirror image of the right side of handrail 16. In one embodiment, uprights 40 are movably attached to base 14 and frame structure 18 of deck 12. Uprights 40 have a lower end 44 movably attached to base 14 and deck 12 and an opposing upper end 42 projecting above front end 28 of deck 12 when deck 12 is in the operational position. Lower end 44 of upright 40 is movably attached to right frame member 22 of frame structure 18. The specific attachment of upright 40 to right frame member 22 will be discussed in further detail below.

Handrail 16 also includes a pair of handles 46 that are fixedly attached to uprights 40 and extend outwardly from uprights 40 toward back end 30 of deck 12. Handle 46 is attached to each upright 40 near upper end 42 thereof. It will be appreciated that the configuration of handles 46 may vary. Handles 46 must be capable of supporting the user of treadmill 10. In addition, handles 46 must be comfortable for a user to grab or hold. Handles 46 are attached to uprights 40 by conventional methods such as screws, bolts, welds, or the like. In one embodiment illustrated in FIG. 1, handles 46 are bolted to uprights 40.

Handrail 16 may comprise an optional control console 54. Console 54 may be attached to upper end 42 of the pair of uprights 40. Control console 54 provides the user interface for monitoring and controlling operation of treadmill 10 and may have operating controls such as an actuator switch to operate treadmill 10 and indicator means which may be operated by the user to determine various parameters associated with the exercise being performed. Console 54 may also include such things as a cup or glass holder so that the user may position a liquid refreshment for use during the course of performing the exercise. It can be appreciated that various embodiments of console 54 are possible and may be so simple as to include only an on/off switch. It is contemplated that console 54 may be completely replaced by a support member.

When deck 12 is in the operational position and handrail 16 is projecting above front end 28 of deck 12, handrail 16 defines the sides of an exercise space therebetween. Handles 46 are designed and positioned such that they are near the hands of the user for easy and quick grasping should a user need handles 46 to maintain his or her balance when the user is exercising on continuous belt 34, as well as making the user feel stable and secure while using treadmill 10.

A pair of elongated supports 56 are movably attached to handrail 16 and deck 12, as shown in FIG. 1. Elongated supports 56 have a first end 58 that is movably attached to upright 40 of handrail 16 and a second end 60 that is movably attached to frame structure 18 of deck 12. As with handrail 16, the right side and left side of treadmill 10 are mirror images and for clarity, only the right side will be discussed in detail. First end 58 of elongated support 56 is pivotally attached to upright 40. Lower end 60 is pivotally attached to side rail 36 of right frame member 20. Other methods of movably attaching first end 58 to upright 40 and second end 60 to side rail 36 are equally effective in carrying out the function thereof.

Figure 2A:
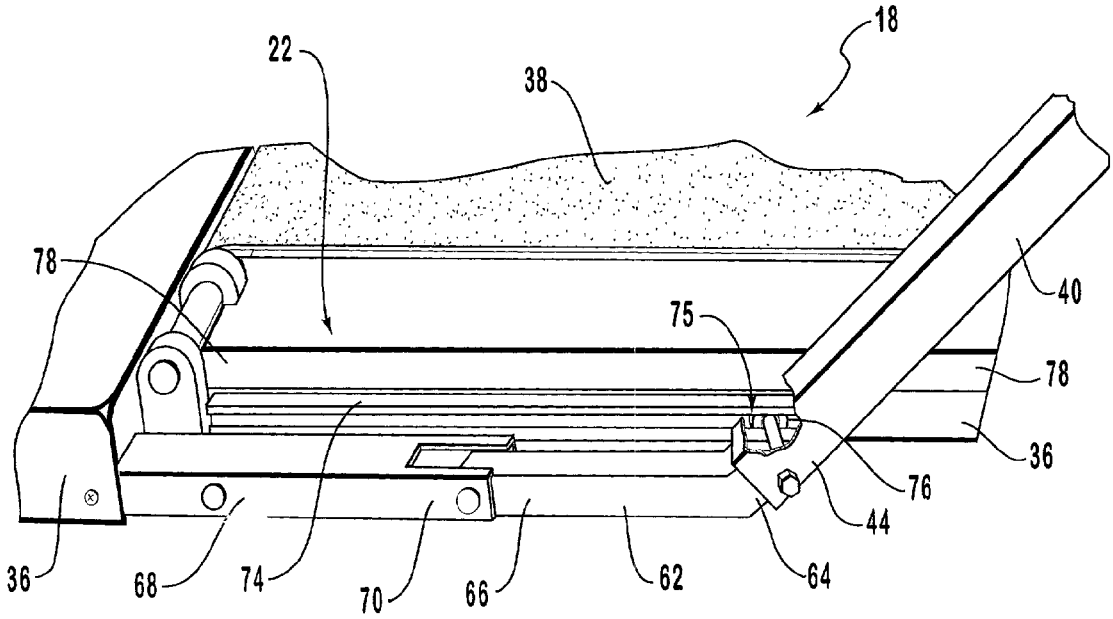
FIG. 2A is an enlarged partial, cutaway perspective view of the fold-out treadmill shown in FIG. 1.

In one embodiment of treadmill 10, lower end 44 of upright 40 of handrail 16 is movably attached to a leg 62. As shown in FIG. 2A, leg 62 has a proximal end 64 that is movably attached to lower end 44 of upright 40 and a distal end 66 that is movably attached to forward end 70 of stabilizer member 68. In the embodiment illustrated in FIG. 2A, distal end 66 of leg 62 is pivotally attached to forward end 70 of stabilizer member 68. Other methods of movably attaching distal end 66 of leg 62 to forward end 70 of stabilizer member 68 are equally effective in carrying out the intended function thereof.

Figure 2B:
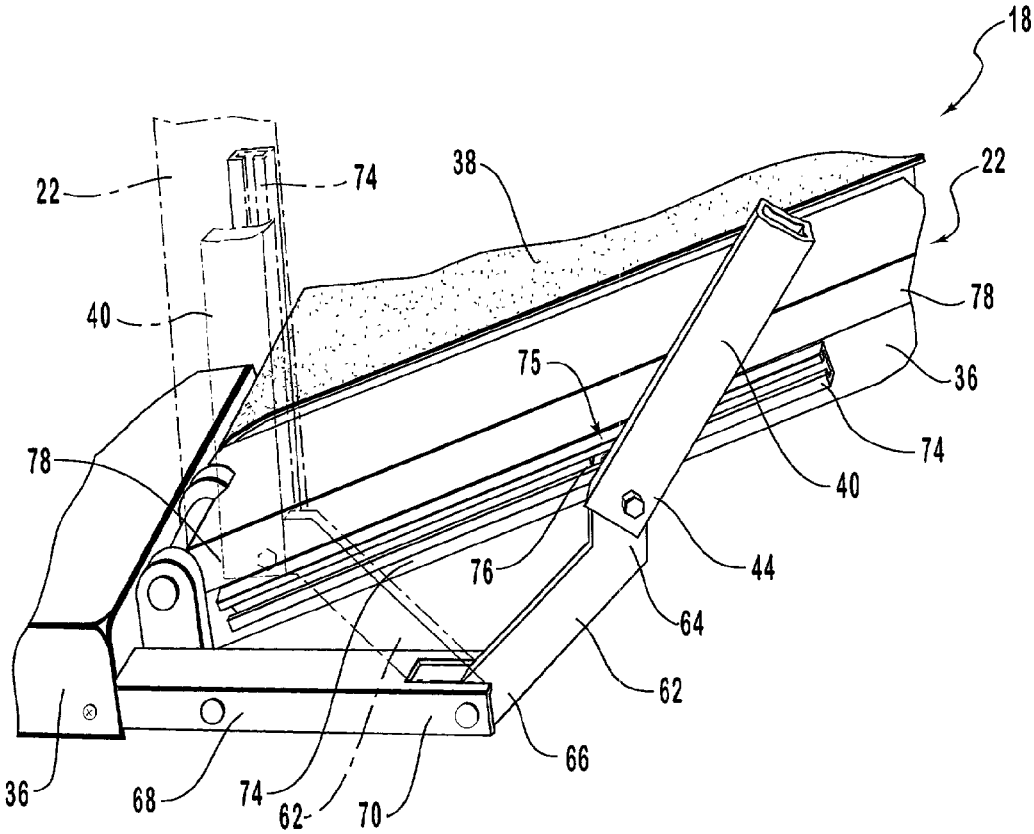
FIG. 2B is a perspective view of the structure shown in FIG. 2A collapsed into a storage position.

Treadmill 10 also has a slider assembly 75 that comprises an elongated slider bracket 74 and a wheel 76. Elongated slider bracket 74 is fixedly attached to the exposed outside surface 78 of both left frame member 20 and right frame member 22. Slider bracket 74 is attached to side rail 36. Slider bracket 74 is capable of receiving wheel 76 rotatably attached to handrail 16 and allowing linear translation of lower end 44 of upright 40 of handrail 16 relative to deck 12. Wheel 76 is configured to cooperate with slider bracket 74 and is disposed therein. Wheel 76 is movably attached to the inside of upright 40 of handrail 16 proximate to deck 12 near or at the point of attachment between lower end 44 of upright 40 and proximate end 64 of leg 62. Elongated slider bracket 74 and wheel 76 illustrated in FIGS. 2A and 2B are one embodiment of structure capable of performing the function of a slider means for allowing linear translation of handrail 16 relative to deck 12.

Elongated supports 56, legs 62, and slider means are one embodiment of structure capable of performing the function of a fold-out means for connecting handrail 16 to deck 12 so as to enable handrail 16 to project above deck 12 when deck 12 is in the operational position and to automatically collapse into substantial alignment with deck 12 when deck 12 is rotated into the storage position. Fold-out means enables deck 12 to be repositioned by pivotal movement from the storage position into the operational position, and simultaneously, handrail 16 to be repositioned by a combination of pivotal movement and linear translation. FIGS. 2A and 2B illustrate the pivotal movement and linear translation allowed by fold-out means when deck 12 is pivoting between the operational position and the storage position, while simultaneously handrail 16 pivots and linearly translates automatically in response to the movement by deck 12.

When treadmill 10 is being repositioned, deck 12 and handrail 16 unfold outwardly so as to allow a user on deck 12 to be facing front end 28 of deck 12 as illustrated in FIG. 1. In those cases that treadmill 10 is selectively stored against a wall 11, deck 12 and handrail 16 unfold outwardly from wall 11 so that a user is both facing away from wall 11 and toward front end 28 of deck 12. It can be appreciated that various embodiments of structure capable of performing the function of such a fold-out means are equally effective in carrying out the intended function thereof.

FIG. 3 illustrates deck 12 in the storage position where handrail 16 has automatically collapsed into substantial alignment with deck 12. In the storage position, deck 12 is positioned proximate to handrail 16. In one embodiment, deck 12 is in the storage position, and deck 12 and handrail 16 are substantially upright. In this configuration, treadmill 10 is significantly more compact and occupies less floor space. When deck 12 is in the storage position, treadmill 10 is supported by base 14. Base 14 comprises body 15 and stabilizer members 68 and is configured to be freestanding. Base 14 stably supports treadmill 10 when deck 12 is in the storage position and during movement between the storage position and operational position.

While the drawings and foregoing description disclose one presently preferred embodiment, it should be appreciated that other handrail configurations may be readily adapted for use with the present invention. For example, instead of handrail 16 folding and unfolding in a single motion as deck 12 is moved between the operational and storage positions, other more simplified handrail configurations can readily be employed wherein deck 12 is rotated between the storage and operational positions in one motion and, then in a second and separate motion, handrail 16 and control console 54 are rotated between their compact storage and their operational positions.

As illustrated in FIG. 3, deck 12 may include a rigid undercover 90 secured to frame structure 18. The rigid undercover 90 may be formed of plastic-like create an essentially rigid underside to deck 12. Although undercover 90 is rigid, undercover 90 may be made of material thin enough to be flexible or to deflect without breaking. Without rigid undercover 90, deck 12 has exposed operating structure, such as electrical components, and any inclination system is exposed. Aside from an undesirable visual appearance, the exposed components can be hazardous because of having sharp edges, points and structures against which things or items may bump or snag. Similarly, there is a risk of exposing any electrical components to moisture as well as exposing the user to an electrical shock hazard if the treadmill is inadvertently not turned off. It may also be noted that undercover 90 may be formed to cover only a portion of the exposed components or may be formed into multiple or removable sections to facilitate any needed repair.

As depicted in FIG. 3, one embodiment of deck 12 includes a pair of feet 92 which are rotatably secured to each side of the frame structure 18. Specifically, feet 92 are pivotally secured to right frame member 22 and frame member 20. Other conventional methods of movably attaching feet 92 are equally effective in carrying out the intended function thereof.

Deck 12 may include a mechanism for automatically varying the inclination of deck 12 relative to the support surface. A motor connected to a rack and a pinion which is connected to feet 92 may be used to vary the inclination of deck 12. Rotatable feet 92 and a mechanism for automatically varying the inclination are one example of structure capable of performing the function of an incline means for varying the inclination of deck 12 relative to the underlying support surface. It is contemplated that various types of known inclination means may be incorporated within deck 12. Other types of inclination means are equally effective in carrying out the intended function thereof.

Figure 4:
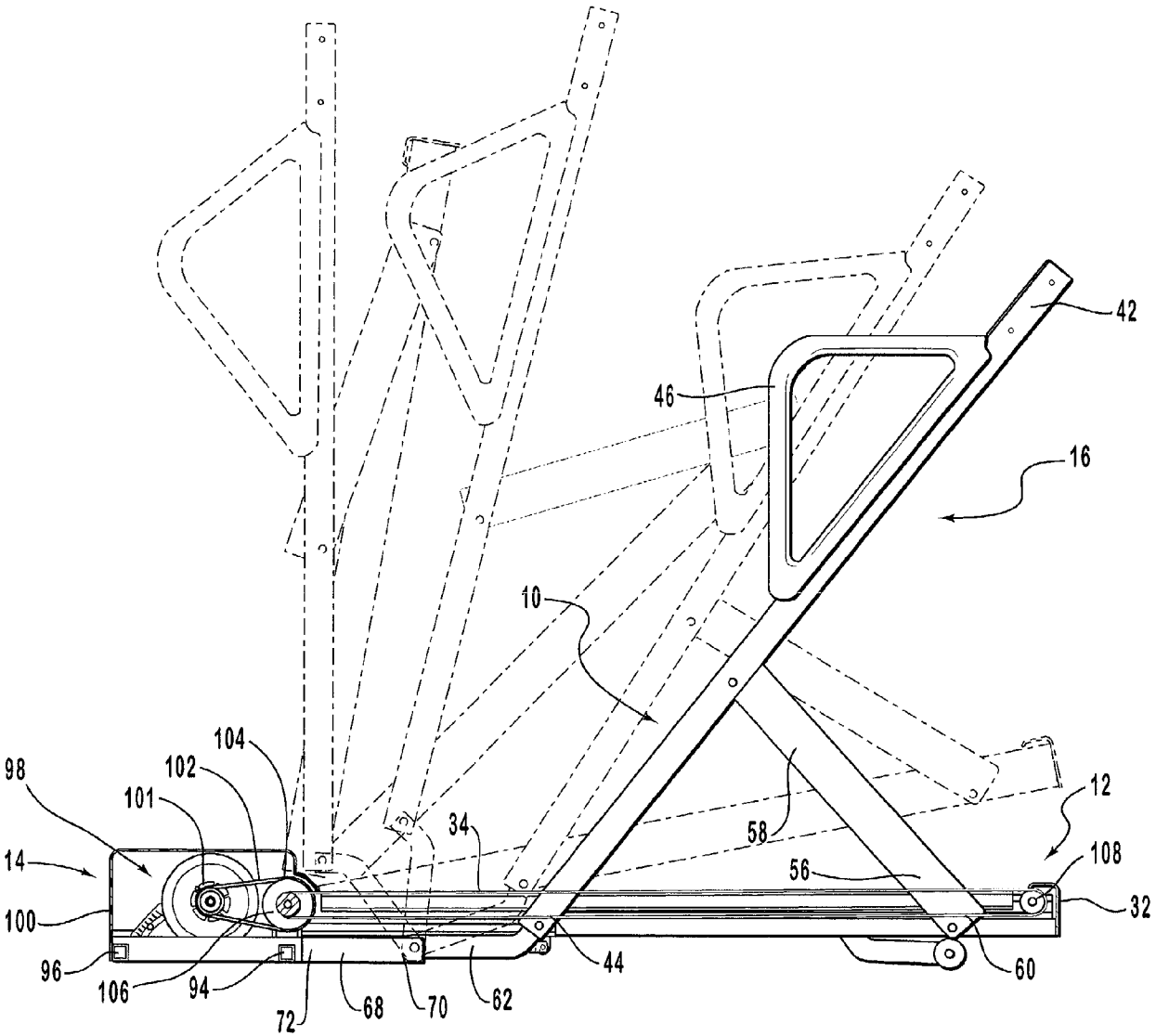
FIG. 4 is a partial cross-sectional, elevation side view of the fold-out treadmill shown in FIG. 1 in the operational position, and illustrates the gradual changes in position that are shown in phantom as the treadmill moves from the operational position to the storage position.

As illustrated in FIG. 4, base 14 has a cover 100 positioned over structure such as a drive means for supplying power to deck 12 to drive continuous belt 34. Cover 100 provides a place for the user of treadmill 10 to stand prior to getting on continuous belt 34 or when stepping off of continuous belt 34 as well as for aesthetics and safety reasons to minimize the risk of materials entering the drive mechanism or otherwise interfering with the operation and mechanism.

Base 14 also comprises a forward cross-support 94 which is disposed between stabilizer members 68. Similarly, base 14 includes a rear cross-support 96 that extends between and is connected to the back-most part of body 15 of base 14. Forward and rear cross-supports 94 and 96, respectively, may be attached to body 15 of base 14 by conventional attachment methods such as by nuts and bolts, brackets, welds, or by braising.

Base 14 is sized and configured so as to provide adequate support to treadmill 10 when deck 12 is in the storage position. Base 14 also provides sufficient support while repositioning deck 12 from the operational position to the storage position when handrail 16 is automatically collapsing into substantial alignment with deck 12. Base 14 is sized to provide treadmill 10 with sufficient support so that deck 12 is stably supported in the storage position, in the operational position and during movement in between. Base 14 is also able to support handrail 16 as it moves simultaneously with deck 12.

Base 14 could be in any desired geometric shape with a predetermined length and width. The length and width are selected so that the distance between the vertical location of the center of gravity of treadmill 10 is such that the force necessary to tip treadmill 10 is necessarily more than that applied by an accidental bump or nudge. The distance base 14, including stabilizing members 68, extends outward away from wall 11 in the direction that deck 12 rotates when moving into the operational position, is selected such that tipping of treadmill 10 can be effected only by a user deliberately seeking to tip treadmill 10.

Similarly, the width of base 14 is selected so that the distance between the center of gravity and the perimeter of base 14 will resist accidental tipping by a bump or nudge. That is, treadmill 10 cannot be tipped sideways except by the application of a user deliberately seeking to tip treadmill 10 sideways.

As illustrated in FIG. 4, treadmill 10 also comprises a motor 98 that rotates a first pulley 101 that drives a belt 102. Belt 102 drives a second pulley 104 connected to rear roller 106 about which continuous belt 34 is disposed. The forward portion of continuous belt 34 also is disposed around a front roller 108. Rear roller 106 and front roller 108 are attached laterally between left frame member 22 and right frame member 24. Motor 98, pulleys 100, 104, and belt 102 are one embodiment of structure capable of performing the function of a drive means for supplying power to deck 12 to drive continuous belt 34. Other embodiments capable of performing the function of such drive means may include a flywheel. Various embodiments of drive means are equally effective in carrying out the intended function thereof.

As can be seen in FIG. 4, motor 98, pulleys 100, 104, and belt 102 are positioned within base 14 to the side of main body 15. The portion of base 14 that includes motor 98, pulleys 100, 104, and belt 102 is slightly raised in height when compared to main body 15. One advantage of having main body 15 separate from the drive means is that the height of main body 15 can be reduced and is closer to the support surface. This makes it easer for the user to step on and off of main body 15 of base 14. Reducing the height of base 14 also reduces the necessary height of deck 12. As a result, the height of the exercise surface formed by endless belt 34 is reduced. The weight of the drive means acts as a counterbalance to stabilize treadmill 10 when deck 12 is being reoriented from the operational position shown in FIG. 1 to the storage position illustrated in FIG. 3.

An alternate embodiment of treadmill 10 includes deck 12 with means comprising a flywheel. Flywheel is connected to the continuous belt 34 and receives energy from the user operating the continuous belt 34 of deck 12. Flywheel also delivers energy to that continuous belt 34 as the user performs walking, running, or jogging exercises when the user is suspended and not in contact with continuous belt 34. In those embodiments of treadmill 10 that utilize a flywheel as a drive means rather than an electric motor, the operator may begin using treadmill 10 once deck 12 has been moved to the operational position.

Deck 12 has a longitudinal length which is selected to facilitate the performance of walking, jogging, or running exercises desired. The length may vary for treadmills configured for walking and treadmills configured for jogging and running. In addition, the length of the continuous belt 34 will vary correspondingly.

Figure 5:
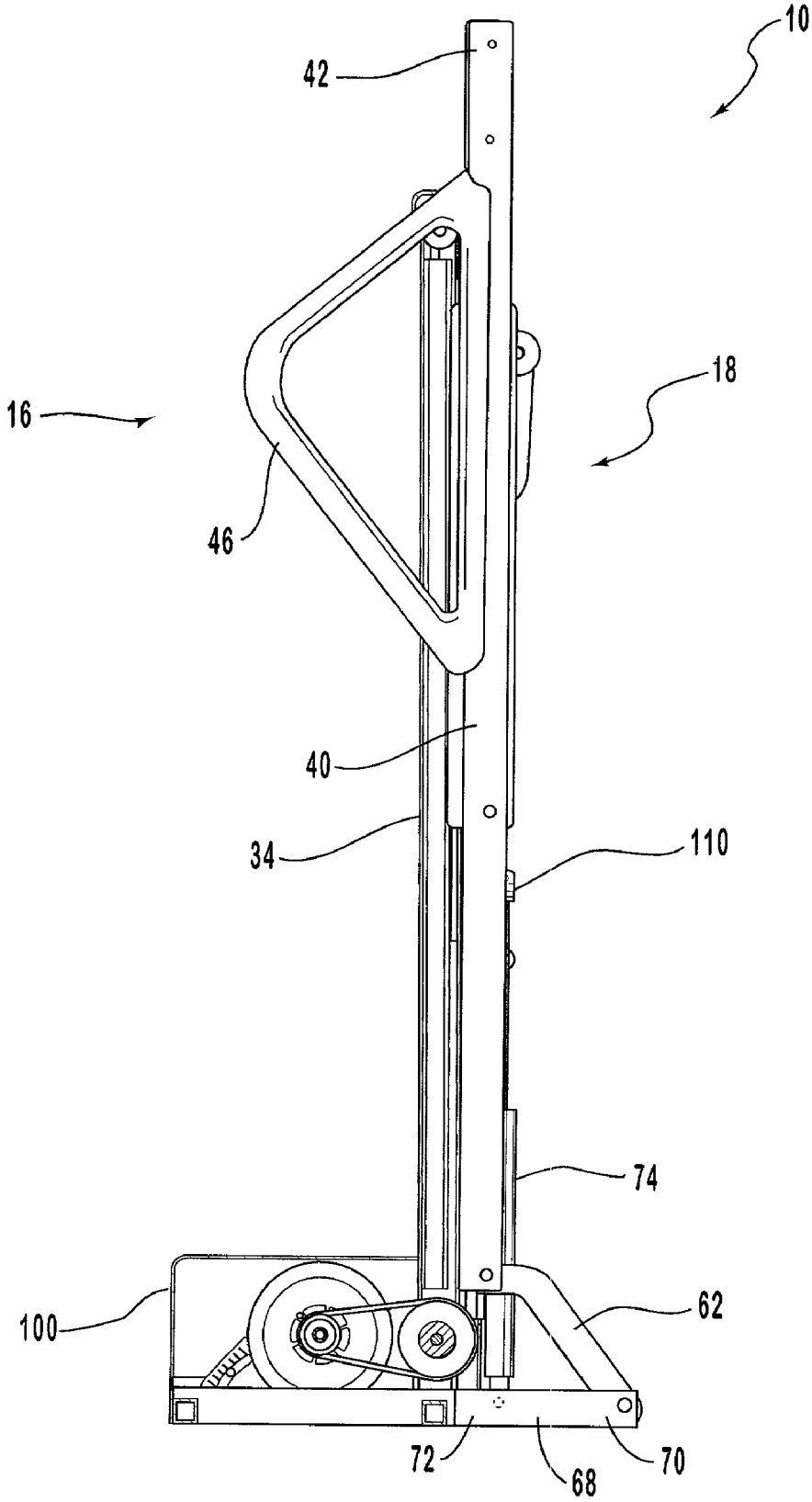
FIG. 5 is a partial cross-sectional elevation view of the treadmill shown in FIG. 3.

For some users, the amount of lifting force necessary to move deck 12 from the operational position to the storage position with handrail 16 automatically collapsing into substantial alignment with deck 12 may be large enough that rotating deck 12 is difficult. FIG. 3 illustrates one embodiment of treadmill 110 that incorporates a pneumatic cylinder 110. Pneumatic cylinder 110 is rotatably attached at one end to deck 12 and the opposite end thereof is attached to stabilizing member 68 of base 14. The embodiment of deck 12 illustrated in FIGS. 3 and 5 have pneumatic cylinder 110 attached to right frame member 22 of frame structure 18 and associated right side of base 14. Pneumatic cylinder 110 could instead be attached to the left frame member 20 of deck 12 and left side of base 14. Alternatively, a pneumatic cylinder 110 could mounted on both sides of deck 12. Pneumatic cylinder 110 is one example of structure capable of performing the function of lift assistance means for applying a force urging deck 12 to move from the operational position to the storage position. Other embodiments of structure capable of performing the function of a lift assistance means are equally effective in carrying out the intended function thereof.

It is also contemplated that handrail 16 may comprise moveable arms rotatably attached to the inside surface of uprights 40. For example, in one embodiment of handrail 16 moveable arms are pivotally attached to uprights 40 with a hand operated knob to tighten and secure moveable arms and to increase or decrease the resistance of the moveable arms to rotation. The moveable arms have a gripping portion configured for grasping by a user.

To use fold-out treadmill 10, a user rotates deck 12 from the storage position shown in FIG. 3 to the operational position as shown in FIG. 1. FIG. 4 shows the various interim positions as deck 12 moves from the operational position to the storage position. In the operational position, base 14, deck 12, and handrail 16 define a "footprint" of treadmill 10. It is intended that the "footprint" of treadmill 10 be regarded as the perimeter of the geometric figure of base 14, deck 12, and handrail 16 projected on to the support surface when tread base 12 is in the operational position. When deck 12 is moved from the storage position to the operational position, handrail 16 automatically moves into a position projecting above the front end 28 of deck 12. As deck 12 is moved between the operational position and the storage position, handrail 16 also moves. At all times during the movement of deck 12 between the operational position and storage position, both deck 12 and handrail 16 remain at all times within the "footprint" of treadmill 10. This enables treadmill 10 to be placed against a wall and remain there while deck 12 is moved between the operational and storage positions without either deck 12 or handrail 16 contacting the wall.

With deck 12 in the operational position, the user stands on continuous belt 34 and walks, jogs, or runs to perform exercises. If the user desires to vary the inclination, the user may, depending on the embodiment of treadmill 10, operate a switch on console 54 to electrically operate the automatic incline means or may manually adjust the incline means shown in FIG. 3 by rotating feet 92. The user may thereafter operate console 54 to energize the motor. In order to operate treadmill 10 utilizing an electric drive means, the user must provide energy to the system by inserting the plug into a conveniently available wall outlet.

Once the user is done exercising on treadmill 10, deck 12 is repositioned into the storage position by lifting front end 28 of deck 12, which causes handrail 16 to automatically collapse into substantial alignment with deck 12 when deck 12 is rotated into the storage position. Specifically, lifting front 28 of deck 12 causes elongated support 56 to rotate downward about the pivotal connection of lower end 60 toward deck 12. The rotational movement of elongated support 56 causes lower end 44 of upright 40 of handrail 16 that is attached to wheel 76 disposed in slider bracket 74 to translate linearly relative to deck 12. The linear translation of upright 40 causes distal end 66 of leg 62 to rotate, while proximal end 64 of leg 62 that is attached to lower end 44 of upright 40 rotates. The rotational movement of the various structural parts as well as the linear translation of handrail 16 relative to deck 12 happens substantially simultaneously while deck 12 is being lifted at front end 28 thereof. The rotational movement and the linear translation of handrail 16 automatically occur every time deck 12 is repositioning between the operational position and the storage position. In addition, the rotational movement and the linear translation of handrail 16 keeps handrail 16 within the "footprint" of treadmill 10.

Although not shown in the figures, it is contemplated that treadmill 10 may also include a latching means for retaining deck 10 in the storage position with handrail 16 collapsed into substantial alignment with deck 12. Those skilled in the art will recognize that various forms and shapes of latching mechanism may be used to facilitate the automatic latching arrangement.

Figure 6:
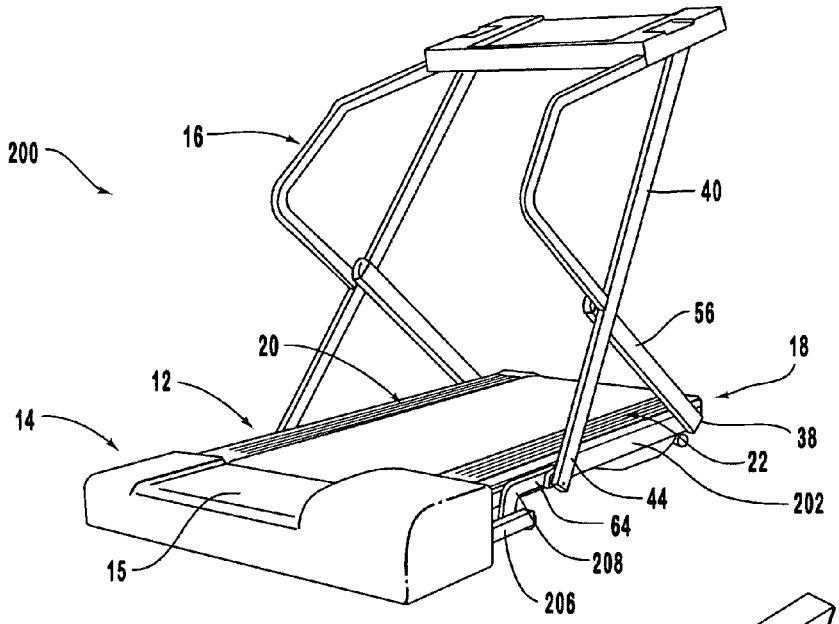
FIG. 6 is a perspective view of another embodiment of the fold-out treadmill in the operational position.

FIG. 6 illustrates another embodiment of a fold-out treadmill 200. The majority of the features previously discussed apply to this embodiment of treadmill 200. The features that are not affected are identified with the same reference numbers as used in FIGS. 1–5. Only those features that have changed will be described in detail.

FIG. 6 depicts another embodiment of treadmill 200 that includes another embodiment of a fold-out assembly. As previously discussed, deck 12 comprises a frame structure 18 that includes a left frame member 20 and a right frame member 22 which are mirror images of each other. In one embodiment of treadmill 200, left frame member 20 and right frame member 22 comprise a side rail 202 and a side base 38. As more clearly shown in FIG. 7, side rail 202 has an elongated aperture 204 formed therethrough.

Treadmill 200, shown in FIG. 6, comprises base 14. In the embodiment illustrated, base 14 includes main body 15 and a pair of stabilizer members 206. As more clearly depicted in FIG. 8, stabilizer members 206 have a forward end 70 and a back end (not shown). In one embodiment, forward end 70 of stabilizer members 206 has a wheel 216 attached thereto. Wheel 216 assists the user in moving treadmill 200 when deck 12 is in the storage position generally depicted in FIGS. 3 and 5.

Figure 7:
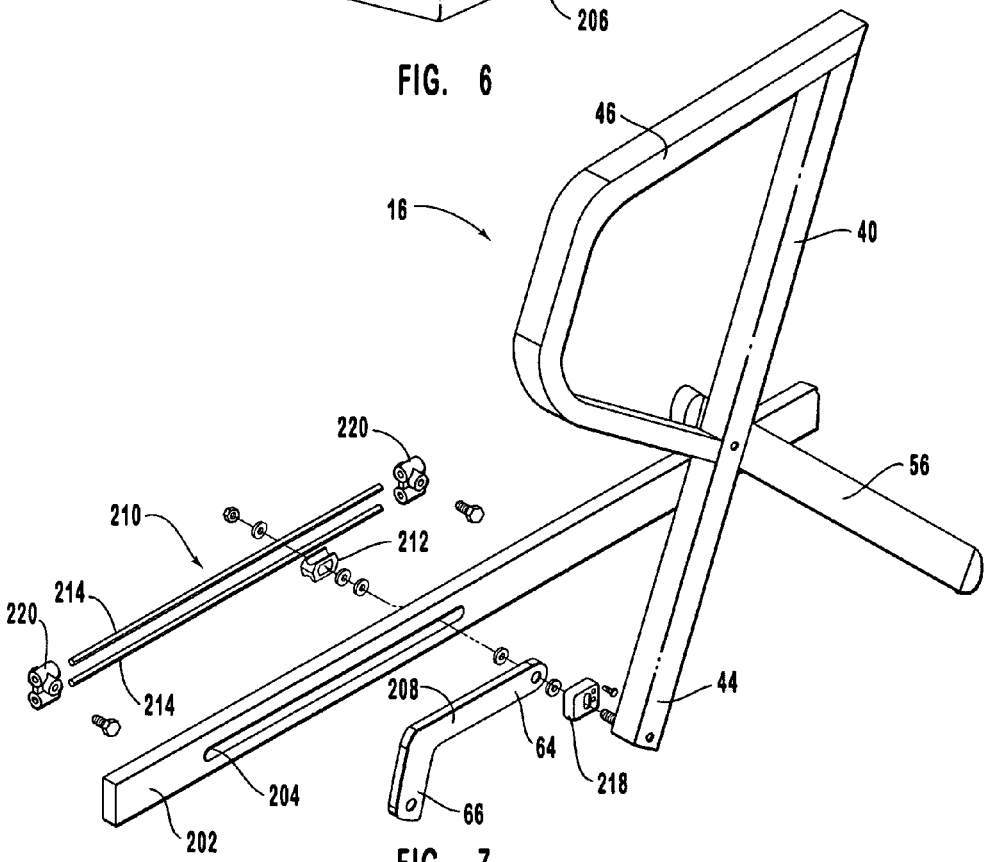
FIG. 7 is a partial exploded perspective view of the fold-out structure of the treadmill of FIG. 6.
Figure 8:
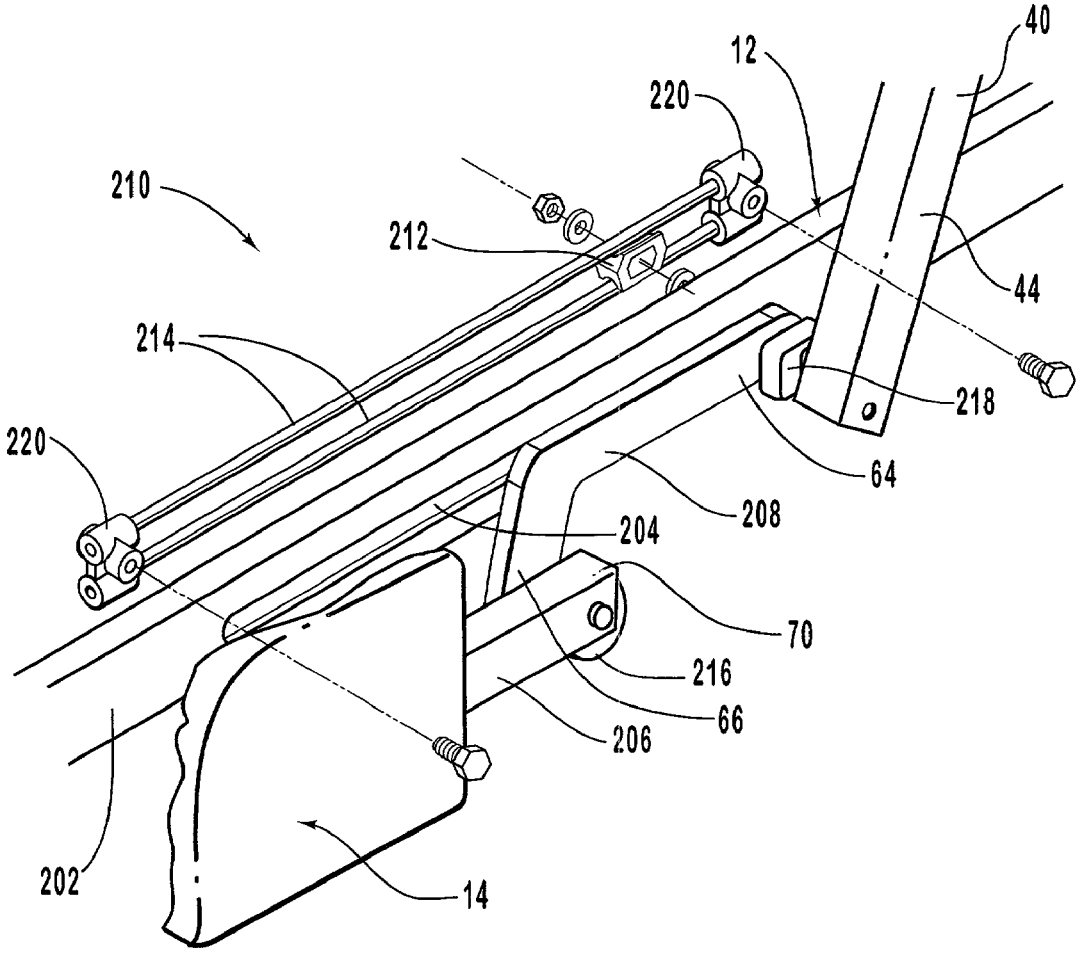
FIG. 8 is a partial exploded view of the structure of FIG. 7.

Treadmill 200 also includes handrail 16 shown in FIGS. 6 and 7. Lower end 44 of upright 40 of handrail 16 is movably attached to a leg 208. As shown in FIG. 7, leg 208 has a proximal end 64 and a distal end 66. Referring now to FIG. 8, proximal end 64 of leg 208 is movably attached to lower end 44 of upright 40. The distal end 66 of leg 208 is movably attached to stabilizer member 206. In one embodiment, distal end 66 of leg 208 is pivotally attached to stabilizer member 206. As illustrated, treadmill 200 includes and an optional spacer member 218 disposed between proximal end 64 of leg 208 and lower end 44 of upright 40.

Referring to FIG. 7, in one embodiment, a fold-out assembly comprises an elongated slider assembly210 attached to the interior of side rail 202, aperture204 formed in side rail 202, leg 208, and support member 56. One embodiment of slider assembly 210 comprises a slider 212 and a pair of slider rods 214. As illustrated, one embodiment of slider rods 214 has a substantially round cross-section. It will be appreciated, however, that slider rods 214 may have various other cross-sectional configurations, such as by way of example and not limitation, oval, elliptical, square, rectangular, and the like, or any combination thereof.

Turning to FIG. 8, a rod housing 220 is mounted on each end of slider rods 214. In one embodiment, rod housing 220 is configured to receive a portion of slider rod 214 therein and to hold them in a substantially parallel relationship.

Slider 212 is disposed between slider rods 214. The outside surface of slider 212 is configured to cooperate with the configurations of slider rods 214. In an alternate embodiment, slider assembly 210 comprises one (1) slider rod and a slider that is configured to be mounted on the slider rod. In this embodiment, the slider has an opening formed therein that is configured to receive the slider rod therein for linear movement. It will be appreciated that various other configurations and arrangements of a slider assembly may be utilized.

As previously mentioned the lower end 44 of upright 40 is pivotally attached to proximal end 64 of leg 208. Lower end 44 of upright 40 and proximal end 64 of leg 204 are slidingly attached to slider assembly 210 through aperture 208 formed in side rail 202. More particularly, lower end 44 of upright 40 and proximal end 64 of leg 208 are attached to slider 212 through aperture 204. Slider 212 is disposed between slider rods 214 so as to allow linear translation of lower end 44 of upright 40 of handrail 16 relative to deck 12 by, for example and not limitation, a bolt, rod, screw, or the like. Other methods of movably attaching lower end 44 of upright 40 and proximal end 64 of leg 208 to slider 212 through aperture 204 in side rail 202 are equally effective in carrying out the intended function thereof. Slider rods 214, slider 212 and aperture 204 in side rail 202 depicted in FIGS. 7 and 8 are one embodiment of structure capable of performing the function of a slider means for allowing linear translation of handrail 16 relative to deck 12.

Elongated supports 56, legs 208, and slider means are one embodiment of structure capable of performing the function of a fold-out means for connecting handrail 16 to deck 12 so as to enable handrail 16 to project above deck 12 when deck 12 is in the operational position and to automatically collapse substantially into alignment with deck 12 when deck 12 is rotated into the storage position. As with the embodiment of fold-out means illustrated in FIGS. 2A and 2B, the embodiment of fold-out means depicted in FIGS. 7 and 8 allows deck 12 to be repositioned by pivotal movement between the operational position and the storage position while substantially simultaneously handrail 16 pivots and linearly translates in response to the movement by deck 12.

In use, fold-out treadmill 200 operates very similarly as treadmill 10. In the operational position, base 14, deck 12, and handrail 16 define a "footprint" of treadmill 200. When deck 12 is moved from the storage position to the operational position, handrail 16 automatically moves into a position projecting above the front end 28 of deck 12. As deck 12 is moved between the operational position and the storage position, handrail 16 also moves. During the movement of deck 12 between the operational position and storage position, both deck 12 and handrail 16 remain at all times within the "footprint" of treadmill 10.

Once the user is done exercising on treadmill 10, deck 12 is repositioned into the storage position by lifting front end 28 of deck 12, which causes handrail 16 to automatically collapse into substantial alignment with deck 12 when deck 12 is rotated into the storage position. Specifically, lifting front 28 of deck 12 causes elongated support 56 to rotate downward about the pivotal connection of lower end 60 toward deck 12. The rotational movement of elongated support 56 causes lower end 44 of upright 40 of handrail 16 that is attached through aperture 204 to slider 212 of slider assembly 210 to translate linearly relative to deck 12. The linear translation of upright 40 causes distal end 66 of leg 208 to rotate, while proximal end 64 of leg 208 that is attached to lower end 44 of upright 40 rotates. The rotational movement of the various structural parts as well as the linear translation of handrail 16 relative to deck 12 happens substantially simultaneously while deck 12 is being lifted at front end 28 thereof.

Figure 9:
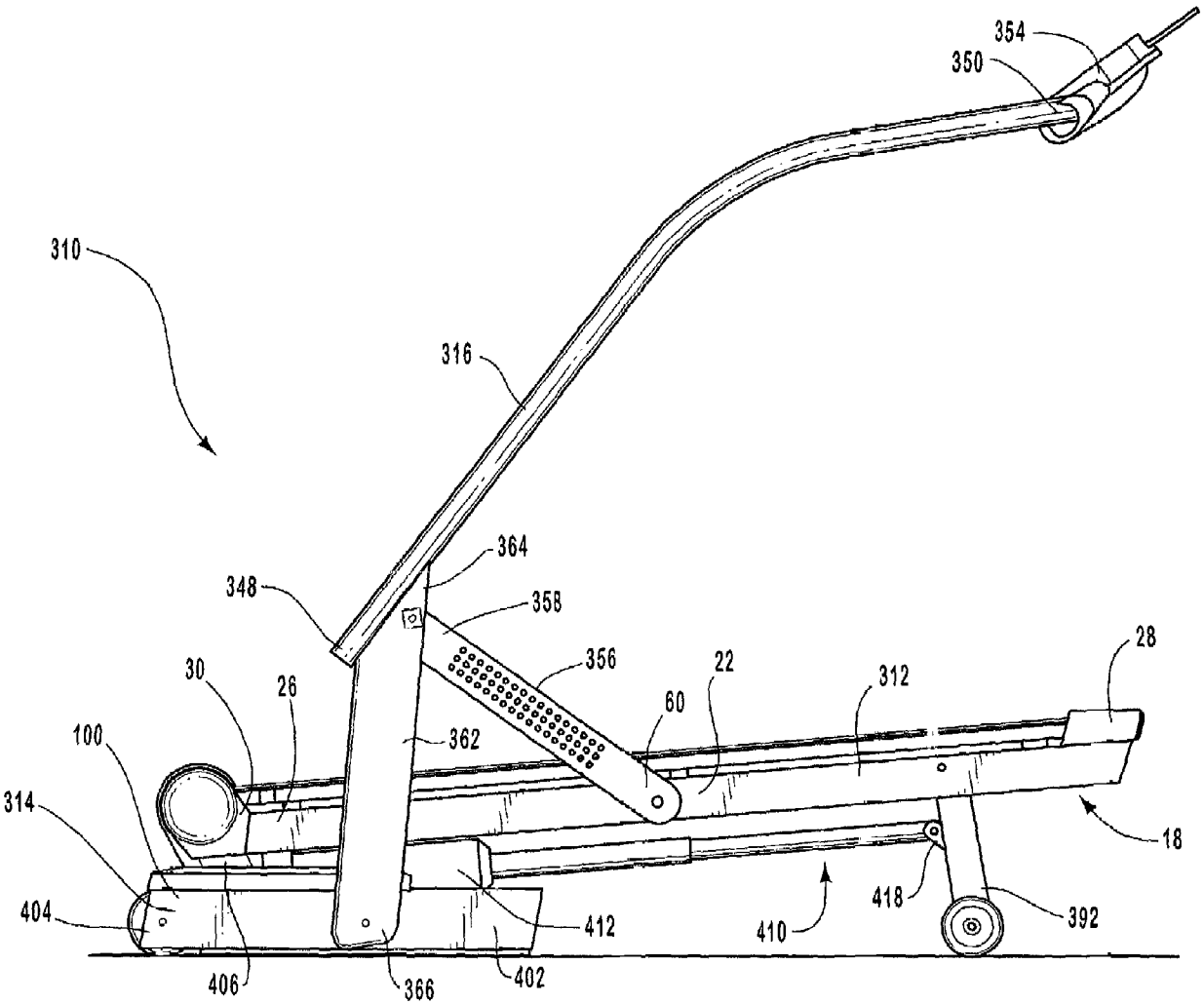
FIG. 9 is an elevation side view of another embodiment of a fold-out treadmill in the operational position with the incline mechanism activated.

FIG. 9 illustrates another possible embodiment of a fold-out treadmill 310. The majority of the features previously discussed apply to this embodiment of treadmill 310. The features that are not affected are identified with the same reference numbers as used in FIGS. 1–8. Only those features that have changed will be described in detail.

As with the previous embodiments of the fold-out treadmill, fold-out treadmill 310 includes a deck 312, a base 314, and a handrail 316. Deck 312 has a back end 30 and a front end 28. Back end 30 of deck 312 is pivotally mounted to base 314. Together, deck 312 and base 314 form a support structure of treadmill 310. Alternatively, only deck 312 or base 314 is the support structure of treadmill 310. One possible embodiment of treadmill 310 is illustrated in FIG. 9 in the operational position. When treadmill 310 is in the operational position, deck 312 extends outwardly from base 314 and is positioned for use by a user. In the operational position, deck 312 may be substantially level or somewhat inclined depending on the user's preference.

Figure 10:
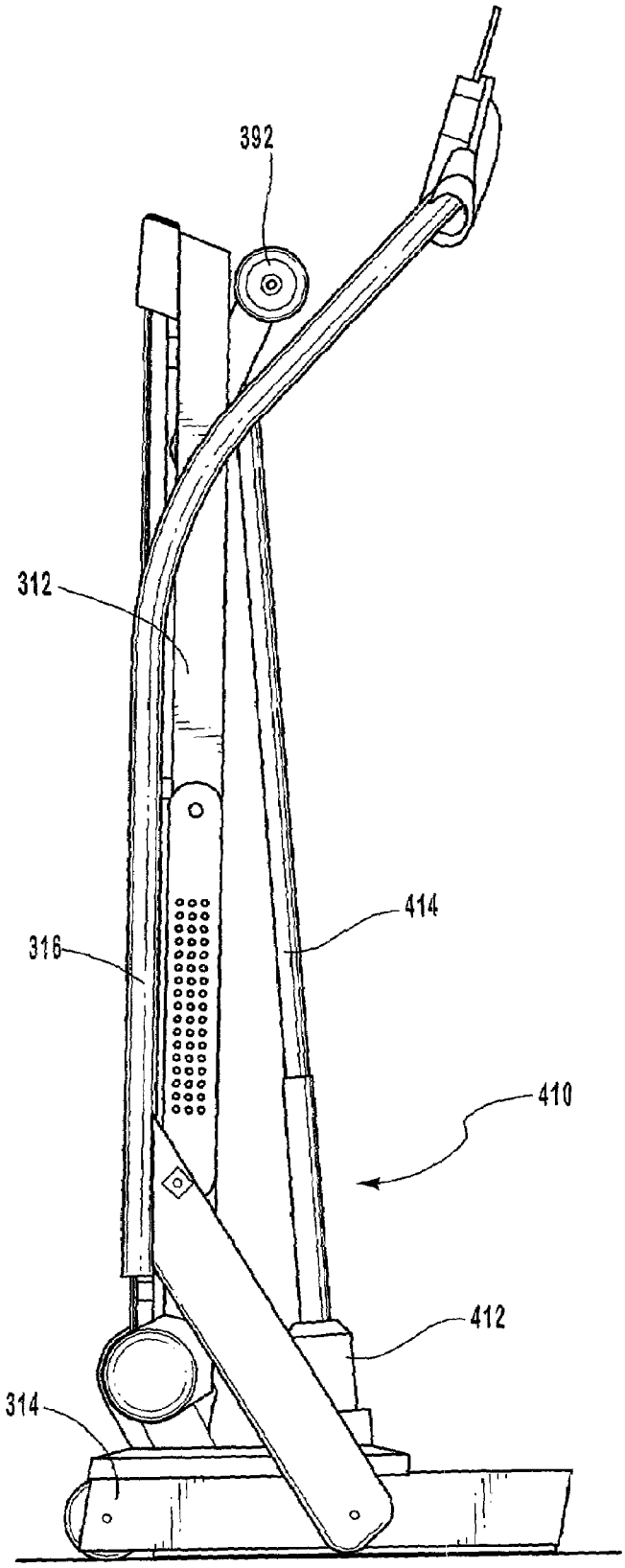
FIG. 10 is a an elevation side view of the treadmill of FIG. 9 in the storage position.

As with the other embodiments of the fold-out treadmill, deck 312 has a storage position in which deck 312 is positioned proximate to handrail 316 as illustrated in FIG. 10. In some embodiments, by way of example and not limitation, deck 312 may be substantially upright when it is in the storage position. Deck 312 can be selectively rotated between the operational and storage position. Although reference is made to "the storage position" being substantially upright, it will be appreciated by one skilled in the art that that treadmill 310 could be "stored" with deck 312 in the operational position.

Figure 12:
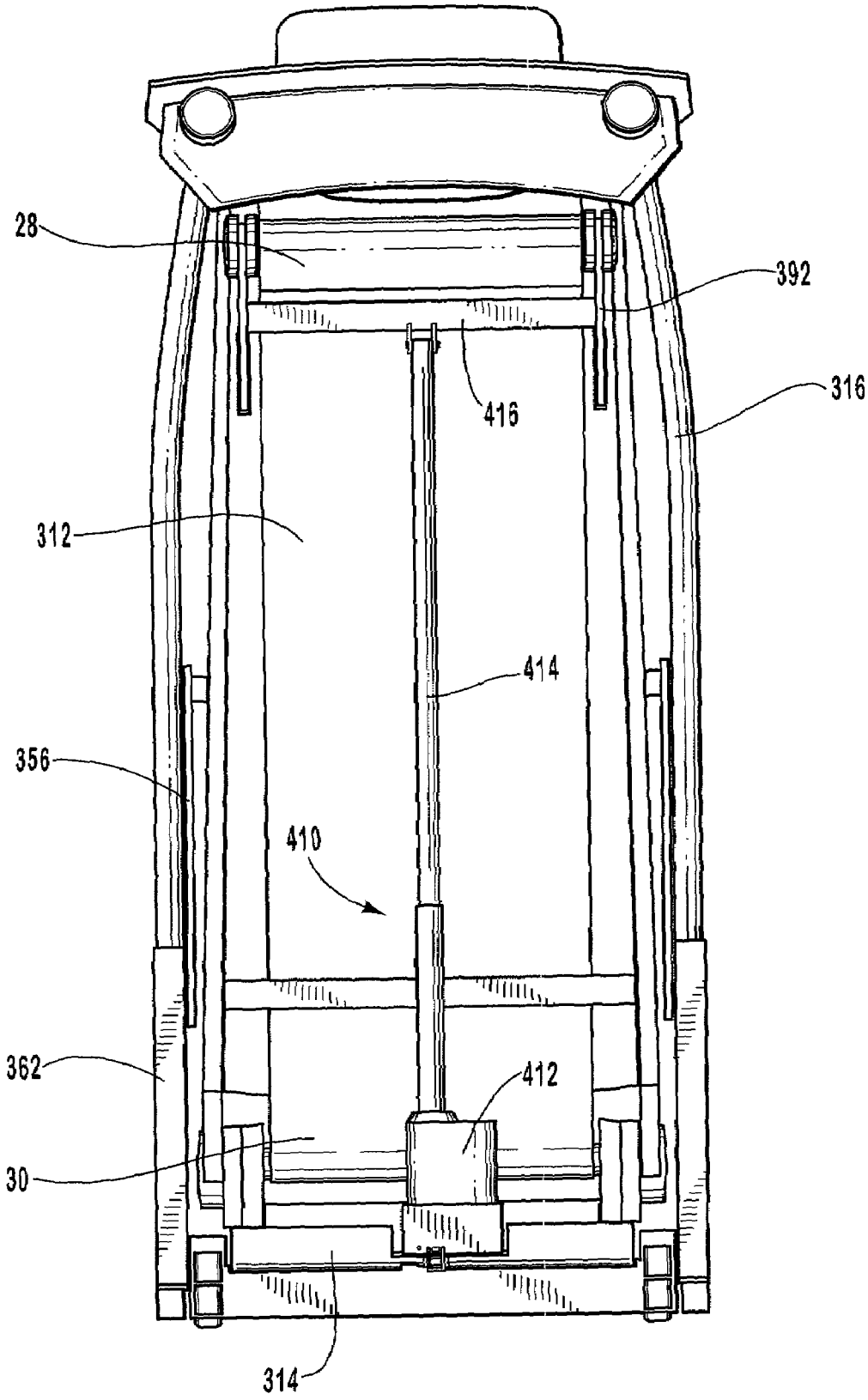
FIG. 12 is an elevation view of the underside of the tread base of the treadmill of FIG. 9 with the protective cover removed.

FIG. 9 depicts one possible embodiment of treadmill 310. Base 314 is movably attached to back end 30 of deck 312. Base 314 has a forward end 402 and a rearward end 404. In this embodiment of treadmill 310, back end 30 of deck 312 is mounted on base 314. In other words, base 314 supports back end 30 of deck 312. More specifically, as shown in FIGS. 9 and 12, back end 30 of deck 312 is rotatably mounted on base 314 toward rearward end 404 of base 314. Although, in other embodiments, back end 30 of deck 312 can be mounted toward forward end 402 or any point intermediate of forward end 402 and rearward end 404. Although in this embodiment base 314 is attached to deck 312 in a slightly different manner than that of treadmill 10, base 314 is similar to base 14 (FIG. 1) in that it includes a cover 100 and drive means (not shown) for driving continuous belt 34 of deck 312.

Base 312 is sized and configured so as to provide adequate support to treadmill 310 when deck 312 is in the storage position. Base 314 also provides sufficient support for treadmill 310 while deck 312 is moving between the operational position to the storage position when handrail 316 is automatically moving into substantial alignment with deck 312. Base 314 is sized to provide treadmill 310 with sufficient support so that deck 312 and handrail 316 are stably supported in the storage position, in the operational position and during movement in between. It will be appreciated that base 314 could have various geometric shapes with a predetermined length and width sufficient to perform the function thereof. As with base 14, the length and with of base 314 are selected so that tipping of treadmill 310 can be effected only by someone deliberately seeking to tip treadmill 310.

Front end 28 of deck 312 is supported on the support surface or floor by a pair of feet 392 which are rotatably secured to each side of the frame structure 18. Alternatively, various other numbers of feet 392 could be used including just one foot. It will be appreciated by one skilled in the art that the right side and the left side of deck 312 are mirror images and for clarity, only the right side will be discussed in detail. Specifically, feet 392 are pivotally secured to right frame member 22 and frame member 20 (not shown). Other conventional methods and mechanisms for movably attaching feet 392 to frame structure 18 of deck 312 are capable of carrying out the intended function thereof. It will be appreciated that rotatable feet 392 are attached to deck 312 in such a manner to have various positions, thereby being giving deck 312 varying inclinations as desired by the user.

In this illustrative configuration, back end 30 of deck 312 is rotatably attached to base 314 by conventional methods. Specifically, back end 26 of both right frame member 22 and left frame member 20 (not shown) are pivotally attached to base 314 near rearward end 400 of base 314. In one embodiment, base 314 has a mounting bracket 406 configured to rotatably cooperate with back end 30 of deck 312. By way of example and not limitation, in one possible embodiment, the rear roller (not shown) for continuous belt 34 is the pivot point for rotatably connecting back end 30 of deck 312 to base 314. In an alternate embodiment, by way of example and not limitation, back end 30 of frame structure 18 of deck 312 could be the pivot point and be rotatably attached to base 314 by various conventional attaching methods including a mounting bracket. Various other embodiments of structure capable of performing the function of a means for connecting a deck to a base so as to enable the deck to selectively rotate between an operational position and a storage position are capable of performing the intended function thereof.

FIG. 9 depicts one possible embodiment of a handrail 316 that is movably attached to the support structure. One possible embodiment of handrail 316 is substantially U-shaped. When deck 312 is in the operational position, handrail 316 is open at the rear-most portion and closed at the front-most portion. As depicted in FIG. 9, when deck 312 is in the operational position, handrail 316 extends across deck 312 at the front end 28 of deck 312. It will be appreciated by one skilled in the art, that various other configurations of handrail 16 are capable of performing the intended function thereof. In one embodiment, by way of example and not limitation, handrail 316 includes a control console 354.

Handrail 316 is configured to automatically reposition into substantial alignment with deck 312 when deck 312 is in the storage postion as illustrated in FIG. 10. Although it is desirable for handrail 316 to automatically reposition into substantial alignment with deck 312 when deck 312 is selectively moved to the storage postion, it can be appreciated by one skilled in the art that handrail 316 may be manually repositioned into substantial alignment with deck 312.

Returning to FIG. 9, in one embodiment, handrail 316 has a first end 348 and a second end 350. It will be appreciated by one skilled in the art that the right side and the left side of handrail 316 are mirror images and for clarity, only the right side will be discussed in detail. First end 348 of handrail 316 is attached to a leg 362. Leg 362 has a proximal end 364 that is attached to first end 348 of handrail and a distal end 366 that is movably attached to base 314. More specifically, as will be discussed in further detail below, distal end 366 of leg 362 is pivotally attached to base 314. It will be appreciated that various other embodiments of handrail 316 and/or leg 362 would be capable of performing the function thereof. By way of example and not limitation, leg 362 could be eliminated and first end 348 of handrail 316 reshaped and extended to pivotally connect to base 314. Similarly, leg 362 could have various other shapes and configurations.

An elongated support 356 is movably coupled with handrail 316 and deck 312. Specifically, elongated support 356 has a first end 58 that is rotatably coupled to handrail 316 and a second end 60 that is rotatably attached to frame structure 18 of deck 312. In one possible embodiment, elongated support 356 is rotatably attached to proximal end 364 of leg 362. It will be appreciated that elongated support could be movingly attached to second end 350 of handrail 316. Handrail 316, elongated support 356, and leg 362 are configured to allow handrail 316 to rotate from extending over front end 28 of deck 312 into substantial alignment with deck 312 when deck 312 is in the storage position. It will be appreciated that various methods of rotatably connecting elongated support 356 to handrail 316 and frame structure 18 of deck 312 may be used to carry out the intended function thereof. For instance, in the configuration where handrail 316 is manually positioned to a storage configuration with deck 312 in a storage position, elongated support could be eliminated and instead leg 362 could include a stop that prevents over rotation of handrail 316.

Elongated supports 356 and legs 362 are one embodiment of structure capable of performing the function of a fold-out, means for connecting handrail 316 to deck 312 so as to enable handrail 316 to project above deck 312 when deck 312 is in the operational position and to automatically move into substantial alignment with deck 312 when deck 312 is rotated into the storage position. In this embodiment, fold-out means enables deck 312 to be repositioned by rotational movement from the storage position into the operational position, and simultaneously, handrail 316 to be repositioned by rotational movement.

When treadmill 310 is being repositioned from the storage position to the operational position, deck 312 and handrail 316 unfold outwardly so as to allow a user on a deck to be facing front end 28 of deck 312 as illustrated in FIG. 9. As previously mentioned, the repositioning of handrail 316 can be performed automatically or manually depending on the configuration of the treadmill. It will be appreciated that various embodiments of structure capable of performing the function of such a fold-out means are capable of carrying out the intended function thereof.

As previously mentioned, FIG. 10 illustrates deck 312 in the storage postion where handrail 316 has automatically moved into substantial alignment with deck 312. In one embodiment, handrail 316 automatically rotates into substantial alignment with deck 312 simultaneously with deck 312 as deck 312 moves from the operational position to the storage position. As illustrated, in the storage position, deck 312 is positioned proximate to handrail 316. In one embodiment, by way of example and not limitation, when deck 312 is in the storage position, deck 312 and handrail 316 are substantially upright, although various other angular orientations of deck 312 and handrail 316 are capable of performing the function thereof. In addition, in one possible embodiment, when deck 312 is in the storage position, treadmill 310 is supported by base 314. Base 314 is configured to be free standing and stably support treadmill 310 at all times including when deck 312 of treadmill 310 is in the storage position and during movement between the storage position and the operational position.

Deck 312 may include a mechanism 410 configured that upon actuation varies the inclination of deck 312 relative to the support surface or floor. In one possible embodiment depicted in FIGS. 9, 10, and 12, mechanism 410 includes a motor 412 movably connected to base 314 and operatively connected to an extension 414 through conventional gearing mechanism and/or linkages. The motion from motor 412 is translated into a linear movement by the conventional gearing mechanisms and linkages so as to change the inclination of the deck 312. In one embodiment, the gearing mechanism or linkage may be, by way of example and not limitation, a worm gear assembly, a rack and a pinion assembly, a ball screw assembly, or the like. It will be appreciated that various types of motors and gearing systems can be used to change the inclination of deck 312.

The gearing mechanism, disposed within an optional housing carrying motor 412 and/or with an optional protective sleeve 420, is attached to extension 414 by conventional attaching means such as a pin or other mechanical attaching devices. In one possible embodiment, extension 414 is rotatably attached to cross-member 416. By way of example and not limitation, in one embodiment, extension 414 is rotatably attached to a cantilever 418 that is fixedly attached to cross-member 416 by conventional attachment methods such as welding, bolts, screws, rivets and the like. Various other possible ways of attaching extension 414 to cross-member 416 include a pin, bearings, or the like. It will be appreciated that various other methods of rotatably connecting extension 414 to cross-member 416 could be used. Cross member 416 is attached to feet 392.

Although FIG. 12 depicts extension 414 being attached to cross member 416 between feet 392, it will be appreciated that extension 414 could be rotatably attached directly to one foot 392 with cross-member extending to another foot 392. Additionally, in an alternate embodiment, there could be two extensions, with each rotatably connected to one of feet 392, and cross-member 416 would be eliminated.

In another possible embodiment of mechanism 410 for varying the inclination of deck 312, motor 412 is connected to a cylinder arrangement that is rotatably connected to cross-member 416 in a similar fashion to extension 414. By way of example and not limitation the cylinder arrangement could be a pneumatic cylinder, hydraulic cylinder, spring or other elastomeric cylinder, or the like. Through operation of motor 412, the cylinder arrangement moves feet 392 to vary the incline of deck 312 of treadmill 310. It will be appreciated by those skilled in the art that various other types of cylinder arrangements could be used to perform the function thereof.

Mechanism 410 is one embodiment of structure capable of performing the function of an incline means for varying the inclination of deck 132 relative to a support surface, such as a floor. It is contemplated that various types of known inclination means may be incorporated within treadmill 310 and are capable of performing the intended function thereof.

It will also be appreciated that various other arrangements of mechanism 410 are capable of performing the intended function thereof. By way of example and not limitation, it will be appreciated by one skilled in the art that mechanism 410 could be mounted entirely to deck 312. In other words, motor 412 of mechanism 410 would be mounted below deck 312 instead of being rotatably attached to base 314.

It will be appreciated by on skilled in the art that the incline means can be actuated and controlled by the user of the treadmill by one or more controls on console 354, which allows the user to actuate mechanism 410 and vary the inclination of deck 312 relative to the support surface as desired.

Mechanism 410 configured to vary the inclination of deck 312 relative to the support surface or floor could also be combined with any of the treadmills shown in FIGS. 1–8. Further, the lift assistance assembly 110 shown in FIG. 3 could be use on treadmill 310 in addition to mechanism 410. The lift assistance assembly 110 from FIG. 3 could have one end attached to base 314 and the other attached to frame structure 18 of deck 312. It will be appreciated that the lift assistance assembly could be in the form of a pneumatic cylinder, hydraulic cylinder, spring or elastomeric cylinder or the like.

Treadmill 310 also includes a mechanism configured to automatically lift and move deck 312 from the operating position to the storage position and visa versa. In one possible embodiment depicted in FIGS. 9, 10, and 12, mechanism 410 performs the function of automatically lifting and moving deck 312 from the operation position to the storage position and visa versa. Alternatively, treadmill 310 can include a separate mechanism, optionally similar to mechanism 410, to perform the lifting and moving function.

Consequently, the mechanism to lift or move deck 312 can include a motor, gearing mechanism, linkage, cylinder arrangement, or the like, as discussed herein or identified from the teaching herein. It will appreciated, that the mechanism to automatically lift or move deck 312 is not required to be the same as the mechanism to vary the incline of deck 312 and can be completely separate and have difference configurations.

Figure 11:
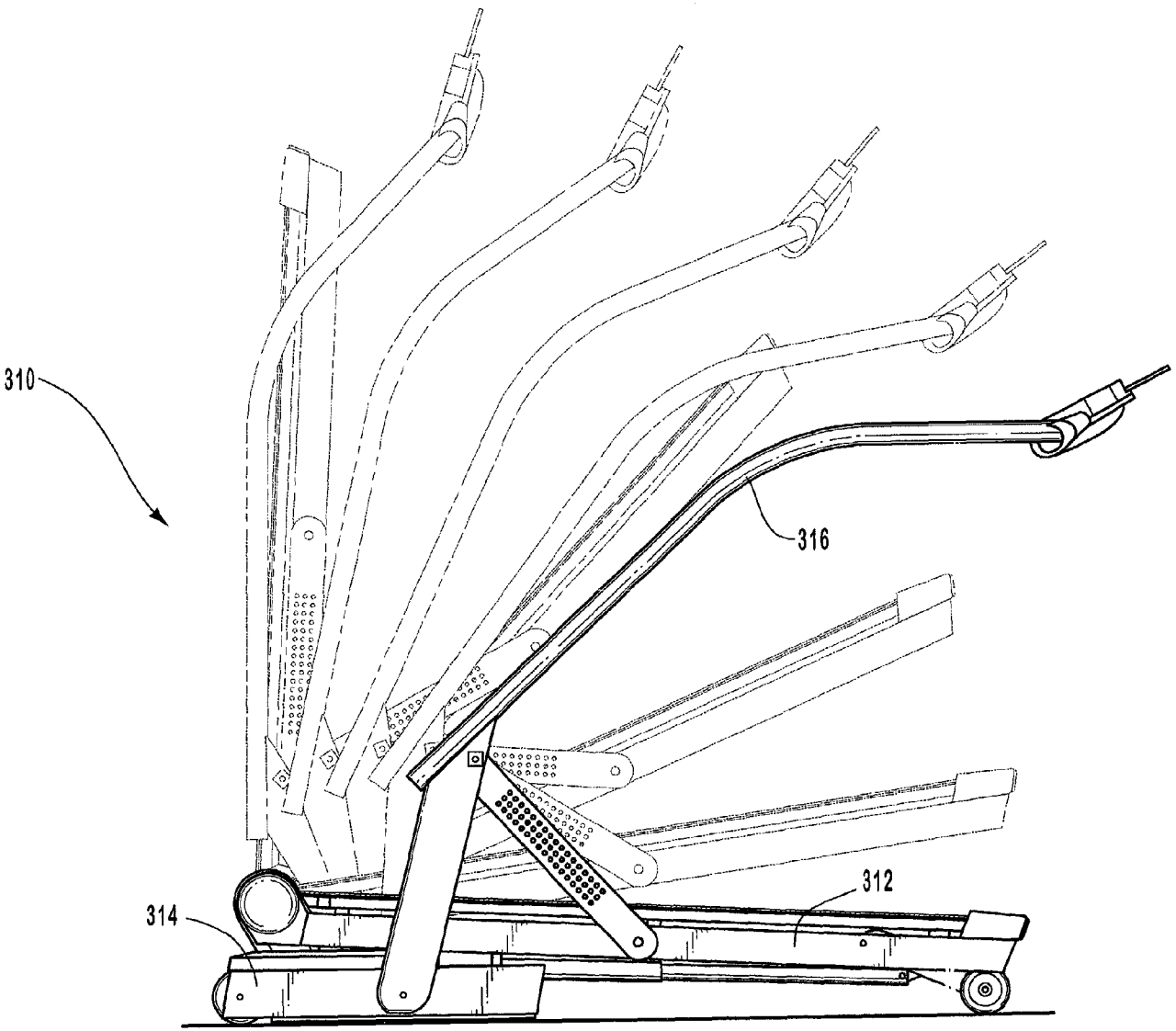
FIG. 11 is an elevation side view of the treadmill of FIG. 9 with the automatic lift mechanism activated, and illustrates the gradual changes in position as shown in phantom as the treadmill moves from the operational position to the storage position by the automatic lift mechanism.

In operation, upon actuation of mechanism 410 for automatically lifting or moving deck 312 from the operating position to the storage position, feet 392 are driven as far forward as they will rotate, such as the position depicted in FIG. 11. As illustrated in FIG. 11, as feet 392 are rotated toward front end 28 of deck 312, feet 392 reach a point where deck 312 begins to have a negative slope or is downhill. In this position, front end 28 of deck 312 is lower than back end 30 of deck 312. As illustrated in FIG. 11, motor 412 of mechanism 410 continues to exert force on extension 414 and drives extension 414 toward front end 28 of deck 312 such that sufficient force is exerted to drive or move deck 312 upwardly and gradually rotate deck 312 into the storage position depicted in FIG. 10. In other words, the configuration of mechanism 410 is such that the force exerted on deck 312 is sufficient to drive, and consequently, rotate, deck 312 upwardly.

As previously mentioned, as deck 312 is rotated toward the storage postion, handrail 316 simultaneously moves and rotates into substantial alignment with deck 312. As can be seen from FIG. 11, as deck 312 rotates toward the storage position, elongated support 356, leg 362, and handrail 316 rotate toward back end 30 of deck 312. It will be appreciated that handrail 316, elongated support 356, and leg 362 are configured to be able to rotate toward back end 30 of deck 312 without contacting support surface, thereby avoiding any interference or binding.

Mechanism 410 is one embodiment of structure capable of performing the function of a lifting means for automatically moving deck 312 between the operational position and the storage position. It is contemplated that various types of automatic lifting means may be incorporated within treadmill 310 and perform the intended function thereof. It will be appreciated that in another embodiment, feet 392 could be eliminated from mechanism 410 and mechanism 410 could be rotatably coupled to a portion of deck 312. Alternatively, feet 392 could be fixedly mounted to frame structure 18. In yet another embodiment feet 392 and cross-member 416 could be eliminated with a portion of mechanism 410 rotatably attached directly to a forward portion of frame structure 18 of deck 312.

It will be appreciated by one skilled in the art that the lifting means can be actuated by the user of the treadmill while not standing on deck 312 actuating a button or switch on console 54 to cause deck 312 to move from the operational position to the storage position or visa versa. In the alternative, there could be a remote control that the user uses to actuate the lifting means.

As described herein, in one embodiment mechanism 410 is configured to both vary the inclination of deck 312 relative to the support surface and automatically lift and move deck 312. It will be appreciated that mechanism can do either one of the recited functions or both of the recited functions. It will also be appreciated that the various alternate configurations would be capable of carrying out the separate functions. One possible advantage of mechanism 410 that is capable of carrying out both functions is that is simplifies the treadmill by combining two mechanisms into one.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A fold-out treadmill comprising:

(a) a base;

(b) a deck having a rear portion, an opposing front portion, and an endless belt rotatably mounted thereon, said deck being movably mounted on said base;

(c) a handrail movably attached to said deck;

(d) said deck configured to be selectively rotated between an operational position in which said deck is positioned for use by a user positioned thereon, and a storage position in which said deck is positioned proximate ate to said handrail; and (e) a mechanism configured to vary the inclination of said deck relative to a support surface, and to move said deck between said operational position and said storage position, wherein said mechanism comprises:

(i) a motor movably attached to said base;

(ii) a foot rotatably mounted below said deck; and (iii) an elongated member having a first end attached to said motor and a second end movably connected to said foot.

2. A fold-out treadmill as recited in claim 1, wherein said handrail does not extend beyond said rear end of said base.

3. A fold-out treadmill as recited in claim 1, wherein said mechanism is moveably attached to said deck.

4. A fold-out treadmill comprising:

(a) a base;

(b) a dock having a rear portion, an opposing front position and an endless belt rotatably mounted thereon, said rear portion of said deck being movably mounted on said base;

(c) a handrail movably attached to said deck;

(d) said deck configured to be selectively rotated between an operational position in which said deck is positioned for use by a user positioned thereon, and a storage position in which said deck is positioned proximate to said handrail; and (e) a mechanism configured to vary the inclination of said deck relative to a support surface, and to move said deck between said operational position and said storage position, wherein said mechanism comprises:

(i) a motor movably attached to said base;

(ii) a foot rotatably mounted below said deck; and (iii) an elongated member having a first end attached to said motor and a second end movably connected to said foot.

5. A fold-out treadmill comprising:

(a) a base;

(b) a deck having a rear portion, an opposing front portion, and an endless belt rotatably mounted thereon, said deck being movably mounted on said base; said deck configured to be selectively rotated between an operational position in which said deck is positioned for use by a user positioned thereon, and a storage position; and (c) a mechanism configured to vary the inclination of said deck from a first operational position to a second operational position in relation to a support surface, and to move said deck between said second operational position and said storage position, wherein said mechanism comprises:

(i) a motor movably attached to said base;

(ii) a foot rotatably attached to said deck; and (iii) an elongated member having a first end operably connected to said motor and a second end movably connected to said foot.

6. A fold-out treadmill as recited in claim 5, wherein said mechanism comprises a motor operably coupled to an extension, wherein said motor and said extension are cooperatively configured to incline said deck, decline said deck, move said deck to an operational position, and to move said deck to a storage position.

7. A fold-out treadmill as recited in claim 5, wherein said mechanism is configured to vary the inclination of said deck relative to a support surface by exciting a force toward said front portion of said deck, and to move said deck between said operational position and said storage position by exerting a continued force toward said front portion of said deck.

8. A fold-out treadmill comprising:

(a) a base;

(b) a deck having a rear portion, an opposing front portion, and an endless belt rotatably mounted thereon, said rear portion of said deck being movably mounted on said base; said deck configured to be selectively rotated between an operational position in which said deck is positioned for use by a user position thereon, and a storage position; and (c) a mechanism configured to vary the inclination of said deck from a first operational position to a second operational position in relation to a support surface, and to move said deck between said second operational position and said storage position, wherein said mechanism comprises:

(i) a motor movably attached to said base;

(ii) a foot rotatably attached to said deck; and (iii) an elongated member having a first end operably connected to said motor and a second end movably connected to said foot.

9. A fold-out treadmill comprising:

(a) a support structure comprising:

(i) a base having a rear end and an opposing front end;

(ii) a deck having a front portion, an endless belt rotatably mounted thereon, and a rear portion said deck being rotatably attached to said base said and configured to selectively rotate between an operational position and a storage position;

(b) a motor operably coupled to an extension and to said deck, wherein said motor moves said extension with respect to said motor to change the incline of said deck; and to move that said deck from said operational position to said storage position; and (c) a fold-out assembly including a handrail having a first end and a second end, wherein said handrail rotates as said deck is selectively rotated from said storage position into said operational position.

10. A fold-out treadmill as recited in claim 9, wherein said base is capable of stably supporting the treadmill when said deck: is in either said operational position or said storage position and when said deck is being repositioned therebetween.

11. A fold-out treadmill comprising:

(a) a support structure comprising:

(i) a base having a rear end and an opposing front end;

(ii) a deck having a front portion, an endless belt rotatably mounted thereon, and a rear portion rotatably attached to said base, said deck configured to selectively rotate between an operational position and a storage position;

(b) a motor operably coupled to an extension and to said deck, wherein said motor moves said extension with respect to said motor to change the incline of said deck and to move said deck from said operational position to said storage position; and (c) a fold-out assembly including a handrail having a first end and a second end, wherein said handrail rotates as said deck is selectively rotated from said storage position into said operational position.

12. A fold-out treadmill comprising:

(a) a support structure comprising:

(i) a base having a rear end and an opposing front end;

(ii) a deck having a front portion, an endless belt rotatably mounted thereon, and a rear portion rotatably attached to said base, said deck configured to selectively rotate between an operational position and a storage position;

(b) a motor operably coupled to an extension and to said deck, whe moves said extension with respect to said motor to change the incline of said deck and to move said deck from said operational position to said storage position; and (c) a fold-out assembly including: (i) a handrail having a first end and a second end, wherein said handrail rotates as said deck is selectively rotated from said storage position into said operational position; (ii) a leg having a proximal end attached to said second end of said handrail and a distal end rotatably attached to said base; and (iii) an elongated support moveably attached to said deck, said leg and said elongated support being configured to allow said handrail to automatically rotate into a compact storage configuration when said deck is rotated from said operational position into said storage position.

13. A fold-out treadmill comprising:

(a) a support structure comprising:

(i) a base having a rear end and an opposing front end;

(ii) a deck having a front portion, an endless bolt rotatably mounted thereon, and a rear portion rotatably attached to said base, said deck configured to selectively rotate between an operational position and a storage position; and (b) motor operably coupled to an extension and to said deck, wherein said motor moves said extension with respect to said motor to change the incline of said deck and to move said deck from said operational position to said storage position, wherein said extension is rotatably coupled to one or more feet.

14. A fold-out treadmill comprising:

(a) a support structure comprising:

(i) a base having a rear end and an opposing front end;

(ii) a deck having a front portion, an endless belt rotatably mounted thereon, and a rear portion rotatably attached to said base, said deck configured to selectively rotate between an operational position and a storage position; and (b) a motor operably coupled to an extension and to said deck, wherein said motor moves said extension with respect to said motor to change the incline of said deck and to move said deck from said operational position to said storage position, wherein said extension is rotatably coupled to one or more feet, wherein said motor declines said deck by moving said extension toward said rear portion of said deck.

15. A fold-out treadmill comprising:

(a) support structure comprising:

(i) base having a rear end and an opposing front end;

(ii) a deck having a front portion, an endless belt rotatably mounted thereon, and a rear portion rotatably attached to said base, said deck configured to selectively rotate between an operational position and a storage position;

(b) a motor operably coupled to an extension and to said deck, wherein said motor moves said extension with respect to said motor to change the incline of said deck and to move said deck from said operational position to said storage position; and (c) a fold-out assembly movably connecting a second end of a handrail to said support structure, wherein a first end of said handrail projects above said front end of said deck when said deck is in said operational position and said fold-out assembly automatically collapses into a compact storage configuration when said deck is rotated into said storage position.

16. A fold-out treadmill comprising:

(a) base;

(b) a deck having a rear portion, an opposing front portion, and an endless belt rotatably mounted thereon said rear portion of said deck being movably mounted on said base;

(c) a handrail movably attached to said deck;

(d) said deck configured to be selectively rotated between an operational position in which said deck is positioned for use by a user positioned thereon, and a storage position in which said deck is positioned proximate to said handrail, wherein said handrail is configured to fold into a storage configuration when said deck is moved from said operational position to said storage position, and to unfold when said deck is moved from said storage position to said operational position, such that said handrail extends above said front portion of said deck when said deck is in said operational position; and (e) a mechanism configured to vary the inclination of said deck relative to a support surface, and to move said deck between said operational position and said storage position.

17. A fold-out treadmill comprising:

(a) abase;

(b) a deck having a rear portion, an opposing front portion, and an endless belt rotatably mounted thereon, said rear portion of said deck being movably mounted on said base; said deck configured to be selectively rotated between art operational position in which said deck is positioned for use by a user positioned thereon, and a storage position;

(c) a mechanism configured to vary the inclination of said deck from a first operational position to a second operational position in relation to a support surface, and to move said deck between said second operational position and said storage position; and (d) a handrail configured to fold into a storage configuration when said deck is moved from said operational position to said storage position and to unfold when said deck is moved from said storage position to said operational position, such that said handrail extends above said front end of said deck when said deck is in said operational position.

18. A fold-out treadmill comprising:

a base;

a deck having a front portion, a rear portion rotatably attached to said base, and a rotating belt;

a handrail rotatably coupled to said base and to said deck; and a motor configured to automatically incline or decline said deck in an operational position and to automatically move said deck from said operational position to a storage position by moving an extension relative to said motor.

19. A fold-out treadmill comprising:

(a) a support structure comprising:

(i) a base having a rear end and an opposing front end;

(ii) a deck having a front portion, an endless belt rotatably mounted thereon, and a rear portion, said deck being rotatably attached to said base and configured to selectively rotate between an operational position and a storage position;

(b) a motor operably coupled to an extension and to said deck, wherein said motor moves said extension with respect to said motor to change the incline of said deck and to move said deck from said operation position to said storage position, wherein said extension is rotatably coupled to one or more feet.

* * * * *

UNITED STATES PATENT AND TRADEMARK OFFICE

CERTIFICATE OF CORRECTION

PATENT NO. : 7,192,388 B2
APPLICATION NO. : 10/083453
DATED : March 20, 2007
INVENTOR(S) : Dalebout et al.

It is certified that error appears in the above-identified patent and that said Letters Patent is hereby corrected as shown below:

Title Pg, Item (56)
Other Publications
Page 5, change "Th Puch Jogger" to --The Puch Jogger--

Column 1
Line 40, change "cause" to --causes--

Column 2
Line 32, after "wall" remove [,]

Column 4
Line 4, change "drawing" to --drawings--

Column 10
Line 20, change "100" to --101--
Line 30, change "100" to --101--

Column 12
Line 51, before "an optional", remove [and]

Column 22
Line 63, change "abase" to --a base--

Signed and Sealed this

Eighteenth Day of March, 2008

JON W. DUDAS
*Director of the United States Patent and Trademark Office*